US006280919B1

(12) United States Patent
Slusarek et al.

(10) Patent No.: US 6,280,919 B1
(45) **Date of Patent: *Aug. 28, 2001**

(54) PHOTOGRAPHIC ELEMENT CONTAINING A STABLE ARYLOXYPYRAZOLONE COUPLER AND PROCESS EMPLOYING THE SAME

(75) Inventors: Wojciech K. Slusarek; Jerrold N. Poslusny, both of Rochester, NY (US); Zheng Z. Wu, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/224,251

(22) Filed: Dec. 30, 1998

(51) Int. Cl.[7] ..... G03C 1/08; G03C 7/26; G03C 7/32

(52) U.S. Cl. ..... 430/555; 430/544; 430/955; 430/956; 430/957; 430/950; 430/959; 430/960

(58) Field of Search ..... 430/544, 555, 430/955, 956, 957, 958, 959, 960

(56) References Cited

U.S. PATENT DOCUMENTS

| | | | | |
|---|---|---|---|---|
| 3,419,391 | | 12/1968 | Young | 430/555 |
| 4,686,175 | | 8/1987 | Ogawa et al. | 430/555 |
| 4,985,336 | | 1/1991 | Ichijima et al. | 430/555 |
| 5,576,167 | | 11/1996 | Poslusny et al. | 430/555 |
| 5,670,306 | * | 9/1997 | Poslusny et al. | 430/555 |

* cited by examiner

*Primary Examiner*—Geraldine Letscher
(74) *Attorney, Agent, or Firm*—Arthur E. Kluegel

(57) ABSTRACT

The invention provides a photographic element comprising a light-sensitive silver halide emulsion layer having associated therewith a coupler based on a 1-aryl-3-arylpyrazol-5-one ring and represented by formula I:

I wherein the substituents are as described in the specification.

22 Claims, No Drawings

PHOTOGRAPHIC ELEMENT CONTAINING A STABLE ARYLOXYPYRAZOLONE COUPLER AND PROCESS EMPLOYING THE SAME

FIELD OF THE INVENTION

This invention relates to a photographic element having a light-sensitive silver halide emulsion layer having associated therewith a stable 1-aryl-3-arylpyrazol-5-one based magenta coupler having an aryloxy group linked by its oxygen atom to the 4-position of the pyrazolone ring.

BACKGROUND OF THE INVENTION

In a silver halide photographic element, a color image is formed when the material is exposed to light and then developed using a primary amine color developer. The development results in imagewise reduction of silver halide and the corresponding production of oxidized developer. The oxidized developer then reacts in an imagewise fashion with one or more incorporated dye-forming couplers to form a dye image.

Magenta dye-forming couplers are employed in subtractive color forming processes. One of the principal coupler types useful for this purpose are those based on a pyrazolone ring. Pyrazolone-based couplers having a coupling-off group linked to the pyrazolone ring by oxygen have long been considered as potentially attractive two equivalent magenta couplers. An oxygen-linked coupling-off group could impart increased activity to the pyrazolone coupler; however the general instability of these couplers toward ambient oxygen makes them difficult to synthesize and impractical for use in a film environment since they decompose during keeping. In particular, pyrazolone couplers having an anilino or acylamino substituent at the 3-position have exhibited unacceptable stability when an aryloxy is employed as a coupling-off group. As a result, pyrazolone couplers have employed either so-called "four equivalent" couplers containing hydrogen at the coupling-off position or have employed so-called "two-equivalent" couplers containing a coupling-off group having a sulfur or nitrogen atom linked to the pyrazolone ring.

U.S. Pat. No. 3,419,391 discloses certain types of pyrazolone-based compounds as two-equivalent couplers having high dye-forming reactivity and reduced tendency to form color fog. According to the patent, the pyrazolone ring is not limited to the presence of any particular substituents at the 3-position or elsewhere. Specifically identified substituents at the 3-position include anilino, acylamino, alkyl, amino, alkoxy, amido, carbamoyl, ureido, thio, guanidino, etc. The couplers of the patent may contain an aryl group at the 1-position and, among other things, an alkyl or carboxy ester group at the 3-position. The aryloxy couplers of the patent are said not to produce color fog (printout) and to provide improved reactivity. Thus, they arc said to provide low printout or yellowing in Dmin areas when they are exposed to light or high temperatures, respectively, subsequent to development. No mention is made of the poor keeping of pyrazolone couplers having aryloxy coupling-off groups although their instability is well known in the art.

U.S. Pat. No. 5,576,167 describes a family of two-equivalent pyrazolone couplers with good stability towards oxygen. The features that make these compounds stable are: (a) an electron-withdrawing CXYZ substituent in the 3-position of the pyrazolone ring, and (b) an aryloxy group, further substituted by electron-withdrawing group(s) in the 4-position of the ring. Although stable, the couplers of this patent require a multistep procedure for their preparation and some of these steps are difficult to perform. None of these references discloses magenta couplers of this invention.

It would therefore be desirable to have a pyrazolone-based coupler with an aryloxy coupling-off group present in a photographic element that is stable during synthesis, film manufacture, and during film keeping and would provide an acceptable hue and reactivity but which would not be difficult to prepare. The 1-aryl-3-arylpyrazolo-5-one magenta dye forming couplers of this invention provide these and other desirable advantages.

SUMMARY OF THE INVENTION

The invention provides a photographic element comprising a light-sensitive silver halide emulsion layer having associated therewith a coupler based on a 1-aryl-3-arylpyrazol-5-one ring and represented by formula I:

I

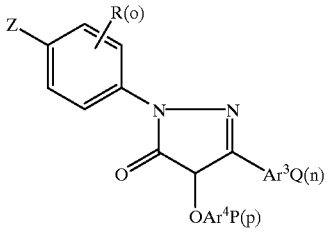

wherein:

Z represents hydrogen, alkyl, aryl, halogen or a group further defined as:

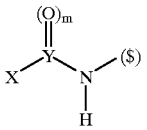

wherein:

X represents an aryl, alkyl, alkylamino, or an arylamino group;

Y represents carbon or sulfur; m is 1 when Y is carbon and 2 when Y is sulfur;

($) denotes the bond connecting the nitrogen atom and the phenyl ring;

R represents a halogen, an alkyl group, an alkoxy group, a cyano group, and a nitro group; and o is 0 to 4; and provided further that R may not be a nitro group ortho to the bond linking the phenyl ring to the 1 position of the pyrazolone ring; and $Ar^3$ represents an aryl group;

Q represents n independently selected substituents bonded to the $Ar^3$ ring, provided that the sum of the appropriate Hammett's σ constants for all Q substituents is at least 0.05; and n is 1 to 5, provided that two or more Q substituents may join to form one or more additional rings;

$OAr^4$ is an aryloxy group;

P represents p independently selected substituents bonded to the aryloxy ring, provided that the sum of the appropriate Hammett's σ constants for all P substituents is at least 0.4, and provided further that P may not be a nitro group ortho to the oxygen atom linking the aryloxy group to the 4 position of the pyrazolone ring, provided that two or more P substituents may join to form one or more additional rings, and p is 1 to 5.

The invention also encompasses a process for forming an image in the described element after exposure to light comprising contacting the element with a color developing chemical.

A photographic element in accordance with the invention exhibits an improved keeping stability of the magenta dye forming coupler and acceptable hue and reactivity even in the absence of a stabilizing, compound.

DETAILED DESCRIPTION OF INVENTION

The aryl group identified at the 1-position, the aryl group identified at the 3-position, and the aryloxy group identified at the 4-position of the pyrazolone ring are independently selected.

In the case where phenyl is selected as an aryl group in the 3-position, it is believed, based on the results of testing, that the proper selection of substituents for this 3-phenyl group can be accomplished by calculating the sum of the Hammett's σ constant values(Σσ) for all of its ring substituents; at least one substituent is needed independently selected from the groups usable as substituents described herein provided that there are among the ring substituent groups sufficient electron withdrawing capacity such that the sum of the Hammett's constant values (Σσ) for all ring substituents $\sigma_p$ for an ortho or para position or $\sigma_m$ for a meta position depending on the location of each said ring substituent group relative to the carbon atom linking the phenyl ring to the pyrazolone ring) is at least 0.05. See "Survey of Hammett Substituent Constants and Resonance Field Parameters", C. Hansch, A. Leo, and R. Taft, Chem. Rev., 91, 165–195, (1991), for a definition of the terms and for a table of constant values for various substituents. Values may also be found in *J. Pharm. Sci* (1987) Vol 76, 48–52.

In the case where phenoxy is selected as an aryloxy group in the 4-position, it is believed, based on the results of testing, that the proper selection of substituents for this 4-phenoxy group can be accomplished by calculating the sum of the Hammett's σ constant values for all of its ring substituents. Because the 4-phenoxy ring is an electron rich group, at least one substituent is needed independently selected from the groups usable as substituents described herein provided that there are among the ring substituent groups sufficient electron withdrawing capacity such that the sum of the Hammett's constant values (Σσ) for all ring substituents ($\sigma_p$ for an ortho or para position or $\sigma_m$ for a meta position depending on the location of each said ring substituent group relative to the oxygen atom linking the phenyl ring to the pyrazolone ring) is at least 0.4. See "Survey of Hammett Substituent Constants and Resonance Field Parameters" as cited above for a definition of the terms and for a table of constant values for various substituents.

In the more general case where additional benzene ring(s) are fused to the 3-phenyl group, creating a 3-aryl group, an adjustment factor may be required in determining the Σσ in accordance with the number of additional rings. Such adjustment values are given for example in Table 7.1 of D. D. Perrin, B. Dempsey and E. P. Serjeant "$pK_a$ Prediction for Organic Acids and Bases", Chapman and Hall, London and New York, (1981) p 67. Thus, in the case where there is no substituent on the 3-aryl ring, the fused carboaromatic system itself must provide a σ adjustment factor so that the total for the ring exceeds the required 0.05. Otherwise, an electron withdrawing substituent is necessary.

In the more general case where additional benzene ring(s) are fused to the 4-phenoxy group, forming a 4-aryloxy group, an adjustment factor may be required in determining the Σσ in accordance with the number of additional rings. Such adjustment values are given for example in Table 7.1 of the "$pK_a$ Prediction for Organic Acids and Bases" as cited above. Thus, in the case where there is no substituent on the 4-phenoxy ring, the fused carboaromatic system itself must provide a σ adjustment factor so that the total for the ring exceeds the required 0.4. Otherwise, an electron withdrawing substituent is necessary.

Examples of electron withdrawing substituents, useful in attenuating the electron density of 3-aryl and 4-aryloxy rings include halogen, —$NO_2$, —CN, —NR'$SO_2$R", —NR'C(O)R", —C(O)N(R')R", —C(O)OR', —OC(O)R', —C(O)R', —$OSO_2$R', —$SO_2$R', —SO2N(R')R", —$SO_2$OR' and halogenated alkyl such as —$CF_3$ wherein each R' and R" is independently hydrogen or a substituent group. Examples of suitable specific substituents include the following: sulfamoyl, such as N-methylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sulfamido, such as hexadecylsulfamido and N-octdecylmethylsulfamido; carbamoyl, such as N-methylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; diacylamino, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl, such as phenoxycarbonyl and p-dodecyloxyphenoxy carbonyl; alkoxycarbonyl, such as alkoxycarbonyl containing 2 to 30 carbon atoms, for example methoxycarbonyl, tetradecyloxycarbonyl, ethoxycarbonyl, phenoxycarbonyl, benzyloxycarbonyl, and dodecyloxycarbonyl; alkoxysulfonyl, such as alkoxysulfonyl containing 1 to 30 carbon atoms, for example methoxysulfonyl, octyloxysulfonyl, tetradecyloxysulfonyl, and 2-ethylhexyloxysulfonyl; aryloxysulfonyl, such as phenoxysulfonyl, 2,4-di-t-pentylphenoxysulfonyl; alkanesulfonyl, such as alkanesulfonyl containing 1 to 30 carbon atoms, for example methanesulfonyl, octanesulfonyl, 2-ethylhexanesulfonyl,and hexadecanesulfonyl; arenesulfonyl, such as benzenesulfonyl, 4-nonylbenzenesulfonyl, and p-toluenesulfonyl. Sulfinyl and sulfoxyl compounds corresponding to the foregoing sulfonyl compounds are also suitable. The 3-aryl and the aryl portion of the 4-aryloxy group are suitably exemplified by groups such as phenyl, naphthyl, anthracyl, and the like.

It is essential that the 4-aryloxy group not include a nitro group ortho to the oxygen atom linking 4-aryloxy to the pyrazolone ring. The exclusion of ortho nitro on 4-aryloxy is necessitated by its very strong destabilizing effect on the corresponding pyrazolone couplers which leads to their very rapid decomposition.

Also within the scope of the invention are couplers which release a photographically useful group (PUG). PUG can be any photographically useful group known in the art. For example, PUG can be a dye or dye precursor, such as a sensitizing dye, filter dye, image dye, leuco dye, blocked dye, shifted dye, or ultraviolet light absorber. Alternatively PUG can be a photographic reagent, which upon release can further react with components in the element. Such reagents include development accelerators or inhibitors, bleach accelerators or inhibitors, couplers (e.g. competing couplers, color-forming couplers, or DIR couplers), developing agents (e.g. competing developing agents or auxiliary developing agents), silver complexing agents, fixing agents, toners, hardeners, tanning agents, fogging agents, antifoggants, antistain agents, stabilizers, nucleophiles and dinucleophiles, and chemical or spectral sensitizers and desensitizers.

Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

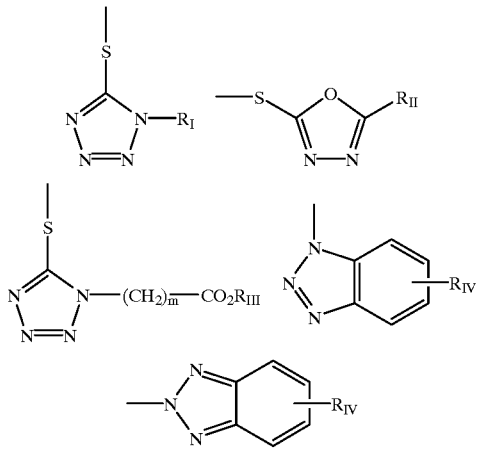

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

The 4-aryloxy group of the invention may function as a timing group and may typically have one of the formulas:

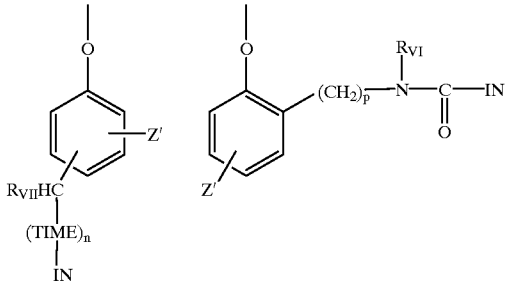

wherein IN is the inhibitor moiety, Z' is an electron withdrawing group such as nitro, cyano, alkylsulfonyl; sulfamoyl (—$SO_2NR_2$); and sulfonamido (—$NRSO_2R$) groups; $R_{VI}$ is an alkyl or phenyl group; $R_{VII}$ is hydrogen or an alkyl group; TIME is a timing group; n is 0, 1, or 2; and p is 0 or 1. The oxygen atom is bonded to the 4-position of the 1-arylpyrazol-5-one coupler.

The 4-aryloxy group of the invention which provides a timed release of the inhibitor and the optional timing group (s) which produce(es) the further time-delayed release of the inhibitor group include those such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above.

It is within the scope of the invention that the coupler of the invention be provided in polymeric form. Thus the coupler may be part of a repeating unit of a polymer. For example, the coupler may be provided via the formula:

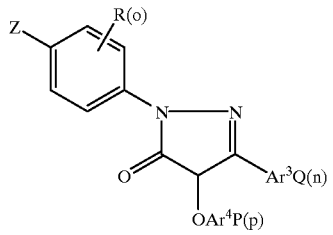

where the substituent $Q_1$ is represented by the group:

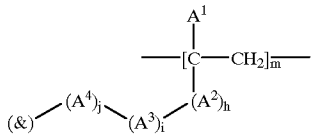

where:

& denotes the point of attachment of $Q_1$ to the $Ar^3$ ring;

m represents the number of repeating ethylene units;

$A^1$ represents a hydrogen atom or a lower alkyl group having 1 to 5 carbon atoms;

$A^2$ represents phenylene, —COO— or —CONH—;

$A^3$ represents an alkylene group such as —$(CH_2)_n$— where n=1 to 10; or arylene such as o-arylene group, m-arylene group, or p-arylene group;

$A^4$ represents —O—, —S—, —N(R)C(O)—, —C(O)N(R)—, —$OSO_2$—, —$SO_2$—, —C(O)O—, —OC(O)—, —N(R)$SO_2$—, and —$SO_2$N(R)— where each R is independently hydrogen or a substituent; and h, i, and j are each 0 or 1 but not all are 0.

When appropriate, another $Q_2$ substituent may be required to make the $\Sigma\sigma$ value of the $Ar^3$ group larger than 0.05.

The coupler can also be a copolymer with at least one repeating unit which is not capable of forming color with oxidized color developing agent.

The invention also encompasses a process for forming an image in the described element by contacting an element which has been exposed to light with a color developing chemical.

Coupler compounds in accordance with the invention are exemplified by the following with the corresponding values for the sum of the Hammett ($\sigma$) constants for the substituents Q in the $Ar^3$ ring, $\Sigma\sigma(Q)$, and for the P substituents in the $Ar^4$ ring, $\Sigma\sigma(P)$, as shown:

| COUPLER FORMULA | | $\Sigma\sigma(Q)$ | $\Sigma\sigma(P)$ |
|---|---|---|---|
| M-1 | 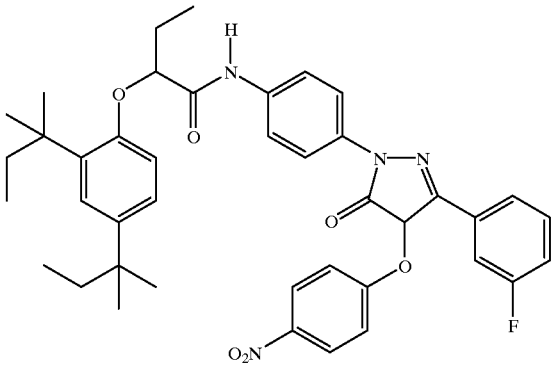 | 0.34 | 0.78 |
| M-2 | 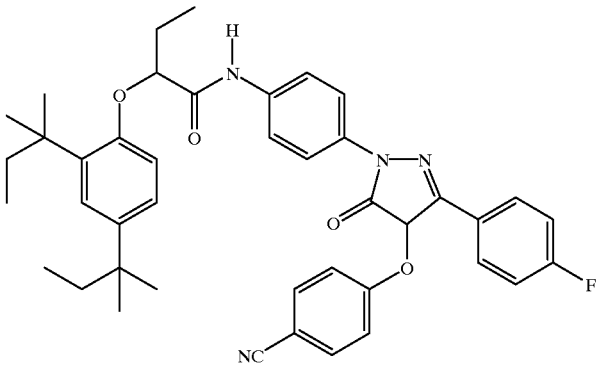 | 0.06 | 0.66 |
| M-3 | 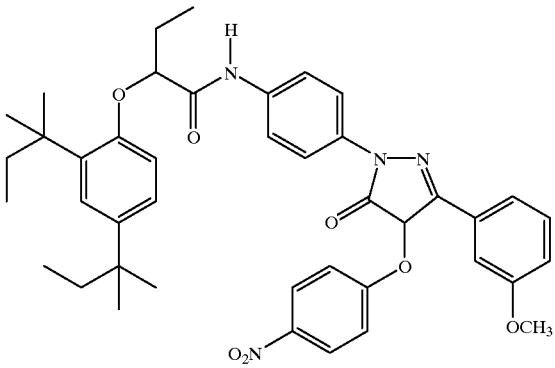 | 0.12 | 0.78 |

-continued
| COUPLER | FORMULA | Σσ(Q) | Σσ(P) |
|---|---|---|---|
| M-4 | 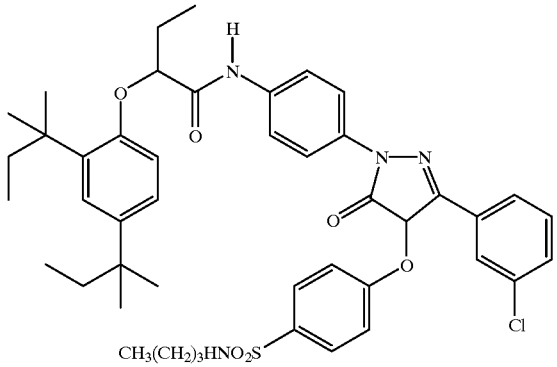 | 0.37 | 0.62 |
| M-5 | 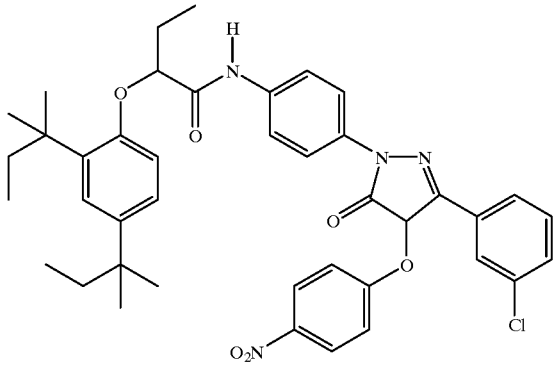 | 0.37 | 0.78 |
| M-6 | 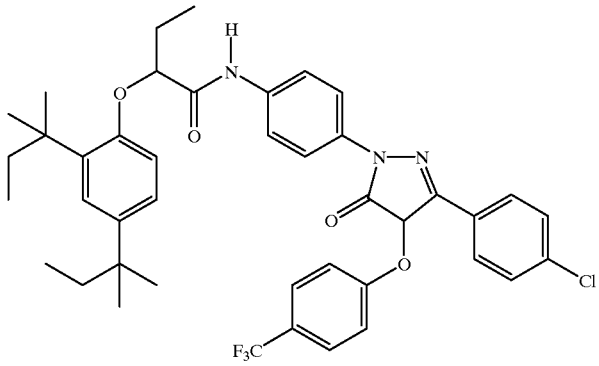 | 0.23 | 0.54 |
| M-7 | 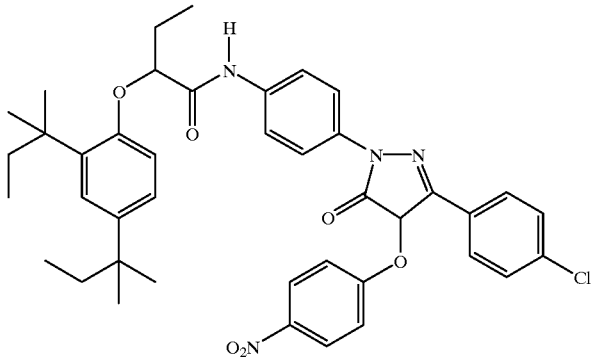 | 0.23 | 0.78 |

-continued
| COUPLER FORMULA | | Σσ(Q) | Σσ(P) |
|---|---|---|---|
| M-8 | 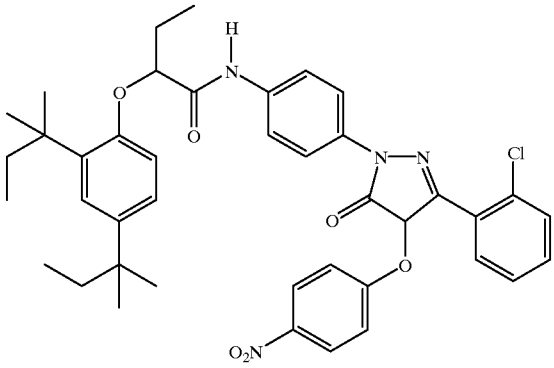 | 0.23 | 0.78 |
| M-9 | 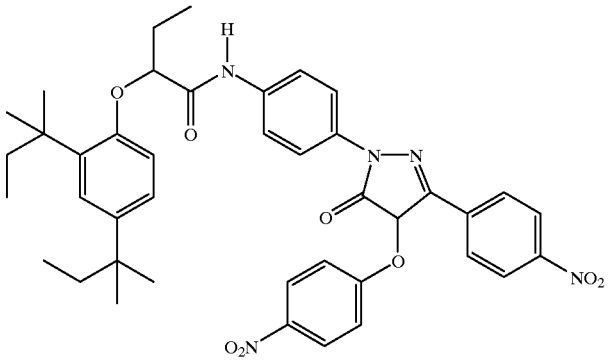 | 0.78 | 0.78 |
| M-10 | 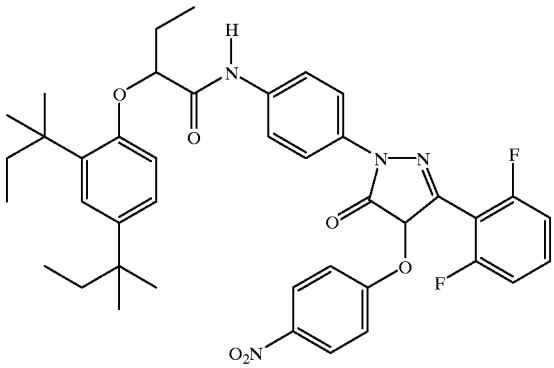 | 0.12 | 0.78 |
| M-11 | 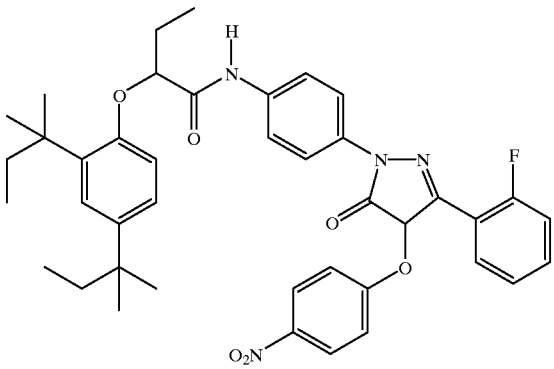 | 0.06 | 0.78 |

-continued
| COUPLER FORMULA | | Σσ(Q) | Σσ(P) |
|---|---|---|---|
| M-12 | 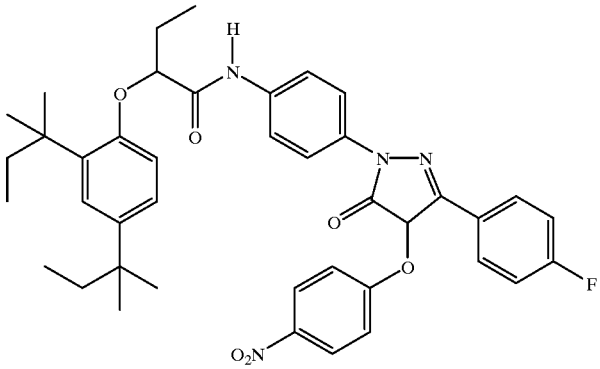 | 0.06 | 0.78 |
| M-13 | 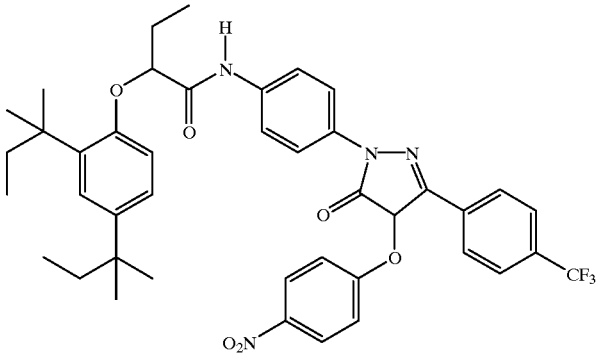 | 0.54 | 0.78 |
| M-14 | 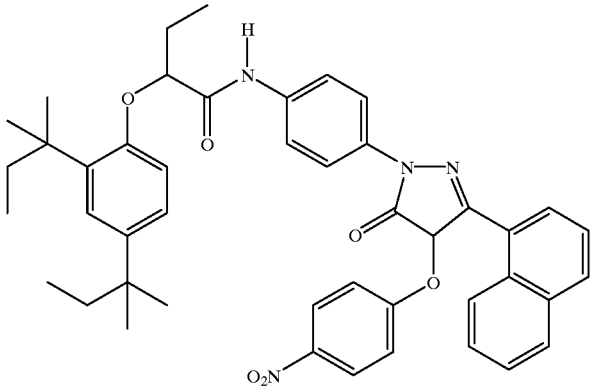 | 0.51 | 0.78 |
| M-15 | 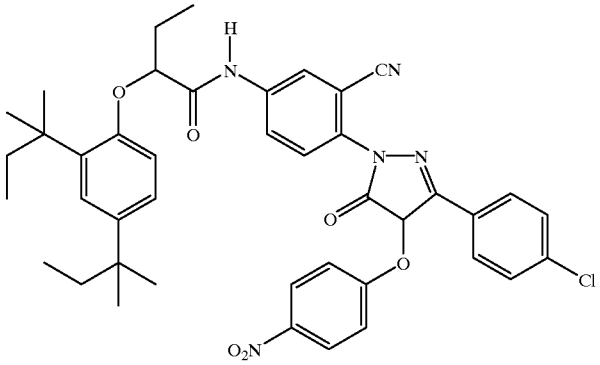 | 0.23 | 0.78 |

-continued
| COUPLER | FORMULA | Σσ(Q) | Σσ(P) |
|---|---|---|---|
| M-16 | 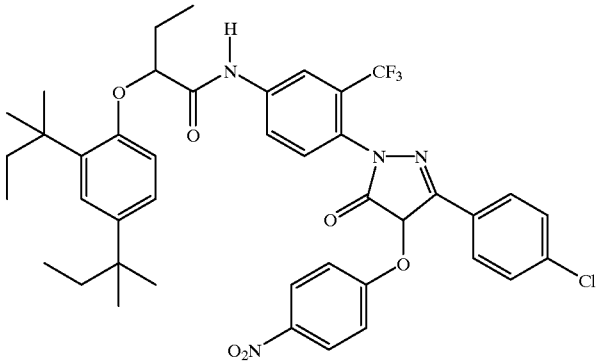 | 0.23 | 0.78 |
| M-17 | 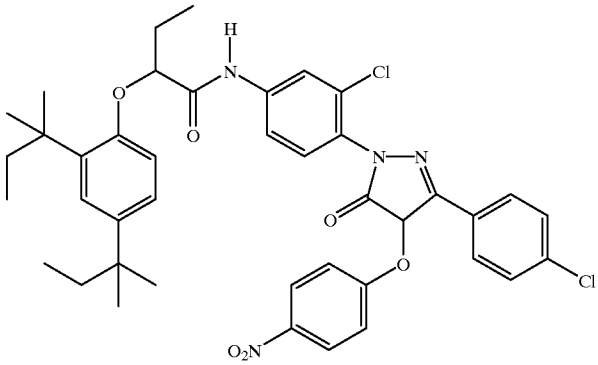 | 0.23 | 0.78 |
| M-18 | 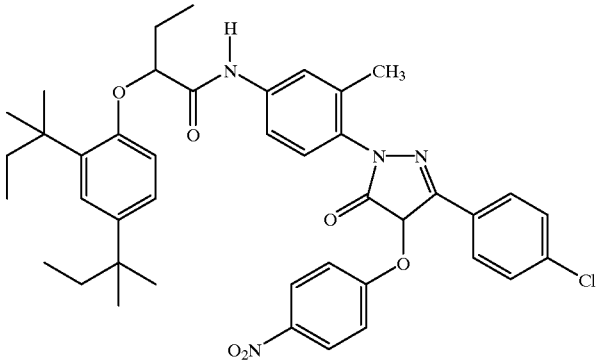 | 0.23 | 0.78 |
| M-19 | 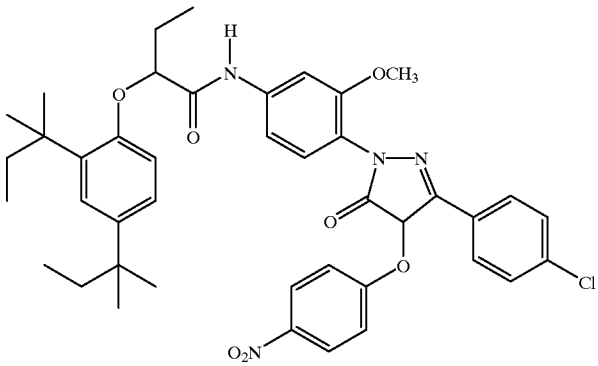 | 0.23 | 0.78 |

-continued
| COUPLER | FORMULA | Σσ(Q) | Σσ(P) |
|---|---|---|---|
| M-20 | 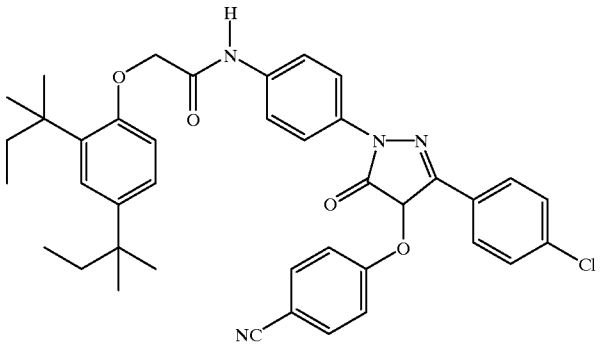 | 0.23 | 0.66 |
| M-21 | 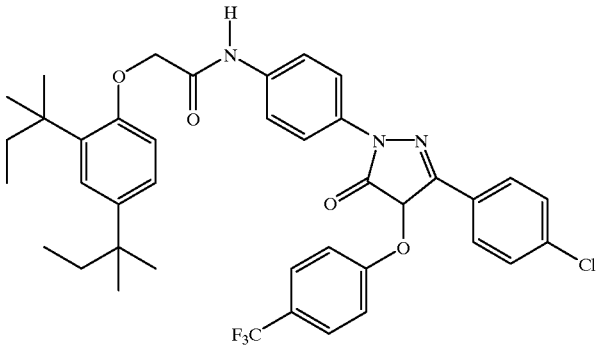 | 0.23 | 0.54 |
| M-22 | 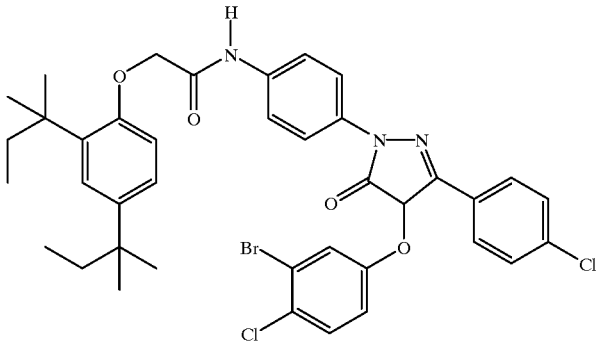 | 0.23 | 0.62 |
| M-23 | 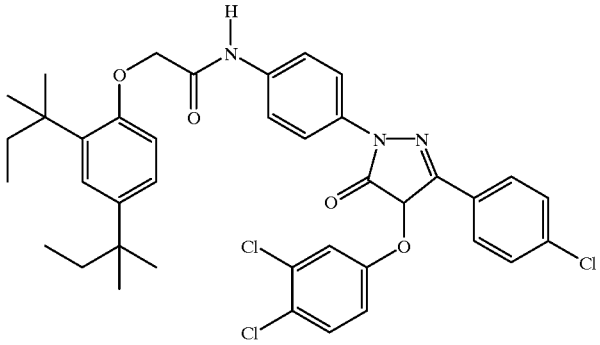 | 0.23 | 0.60 |

-continued
| COUPLER | FORMULA | Σσ(Q) | Σσ(P) |
|---|---|---|---|
| M-24 | 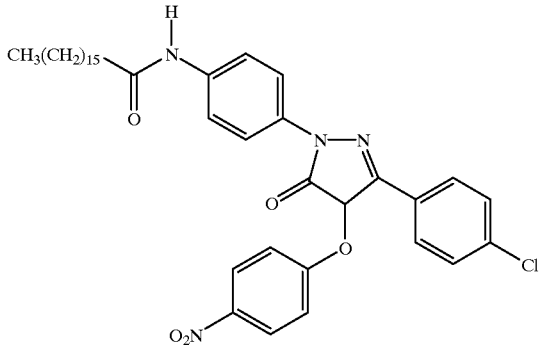 | 0.23 | 0.78 |
| M-25 | 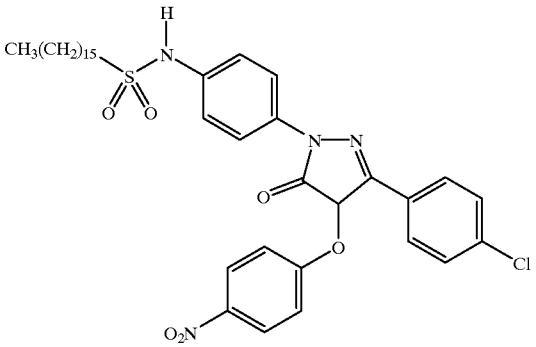 | 0.23 | 0.78 |
| M-26 | 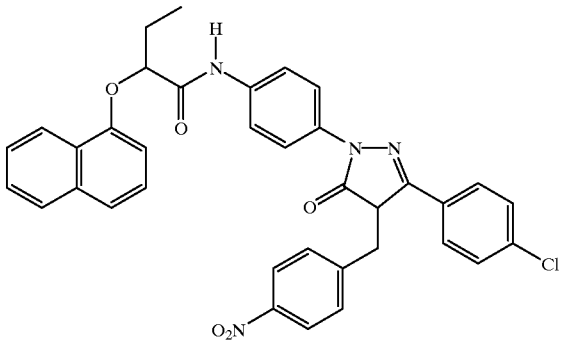 | 0.23 | 0.78 |
| M-27 | 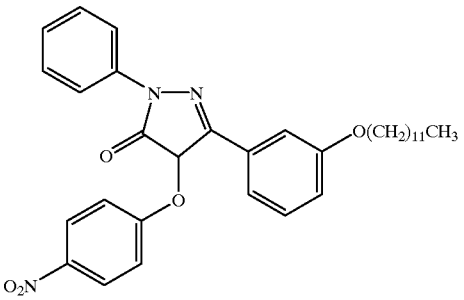 | 0.10 | 0.78 |

-continued
| COUPLER | FORMULA | Σσ(Q) | Σσ(P) |
|---|---|---|---|
| M-28 | 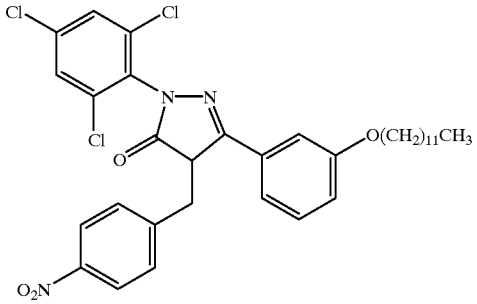 | 0.10 | 0.78 |
| M-29 | 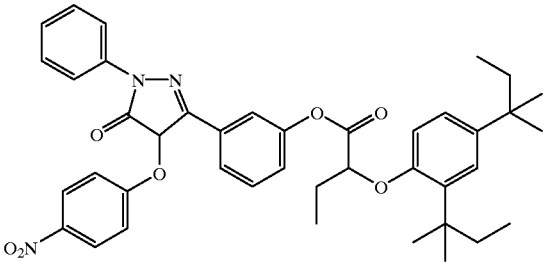 | 0.39 | 0.78 |
| M-30 | 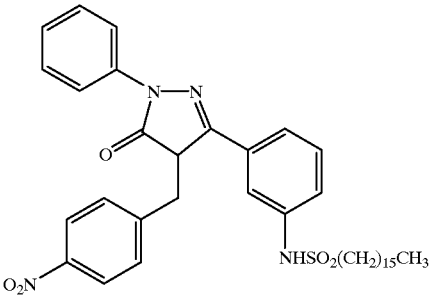 | 0.20 | 0.78 |
| M-31 | 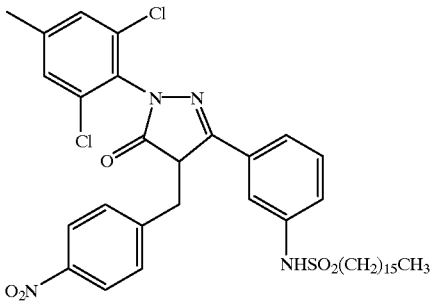 | 0.20 | 0.78 |
| M-32 | 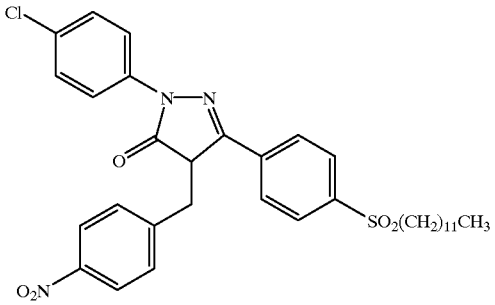 | 0.72 | 0.78 |

-continued
| COUPLER | FORMULA | Σσ(Q) | Σσ(P) |
|---|---|---|---|
| M-33 | 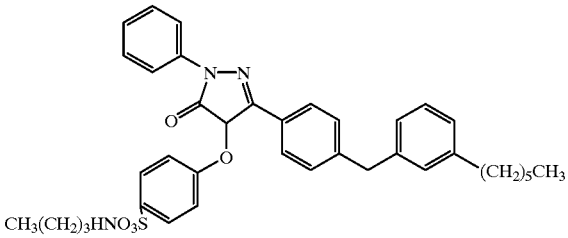 | 0.68 | 0.62 |
| M-34 | 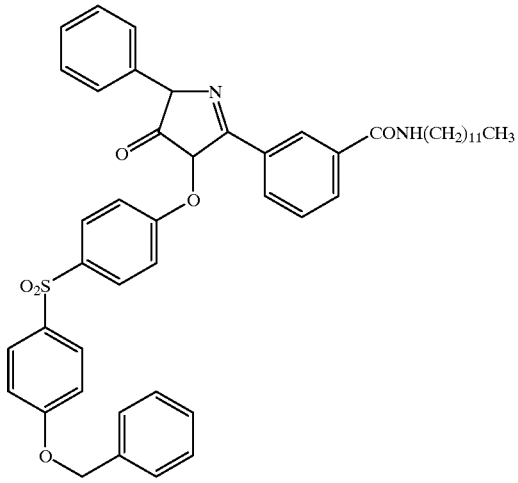 | 0.35 | 0.68 |
| M-35 | 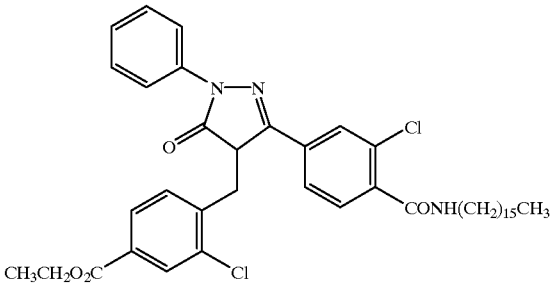 | 0.73 | 0.68 |
| M-36 | 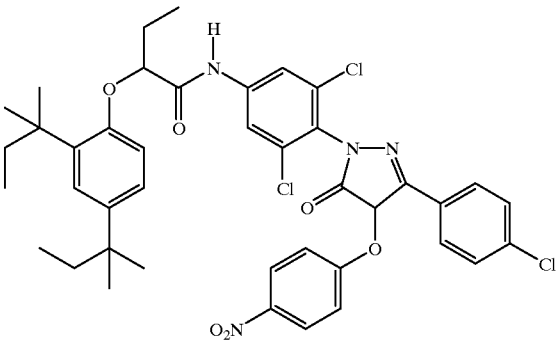 | 0.23 | 0.78 |

-continued
| COUPLER FORMULA | | Σσ(Q) | Σσ(P) |
|---|---|---|---|
| M-37 | 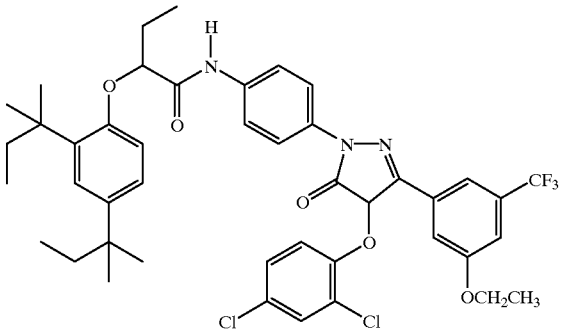 | 0.53 | 0.46 |
| M-38 | 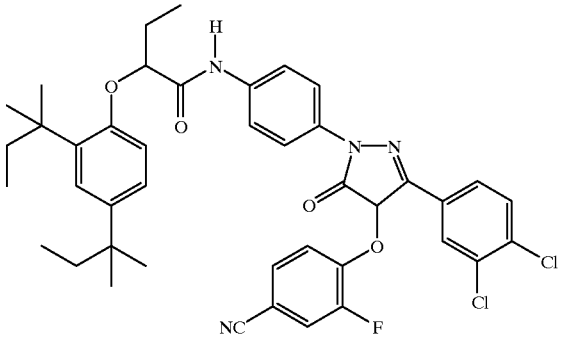 | 0.60 | 0.72 |
| M-39 | 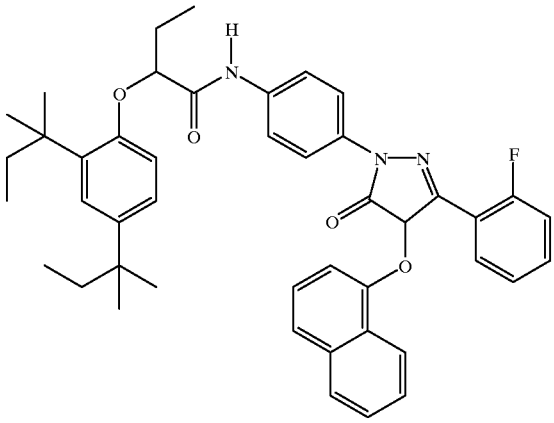 | 0.06 | 0.51 |
| M-40 | 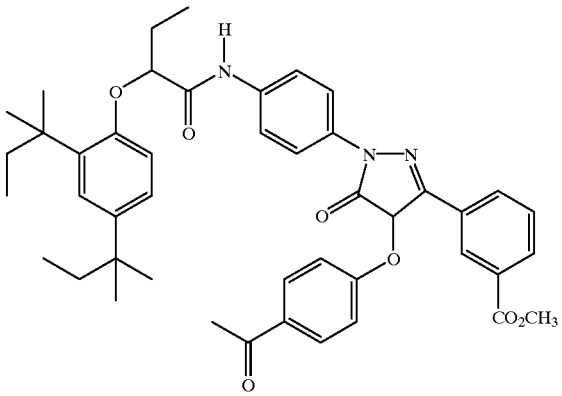 | 0.37 | 0.50 |

-continued
| COUPLER | FORMULA | Σσ(Q) | Σσ(P) |
|---|---|---|---|
| M-41 | 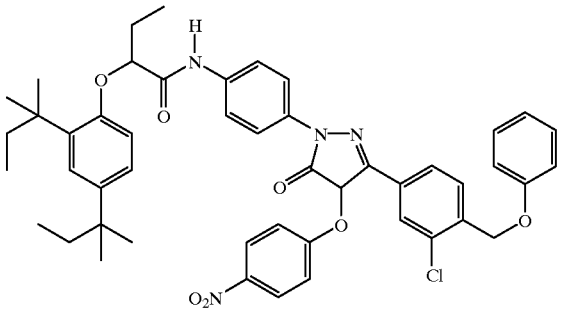 | 0.44 | 0.78 |
| M-42 | 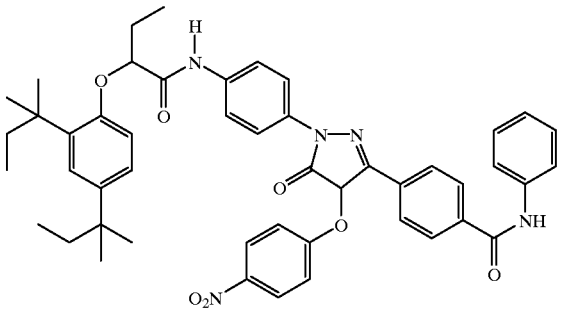 | 0.41 | 0.78 |
| M-43 | 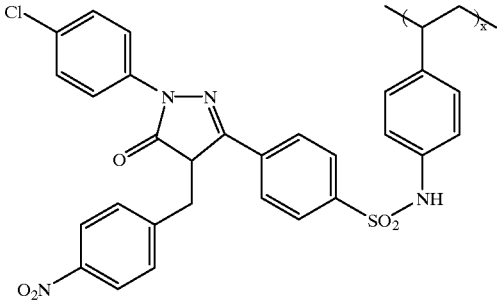 | 0.56 | 0.78 |
| M-44 | 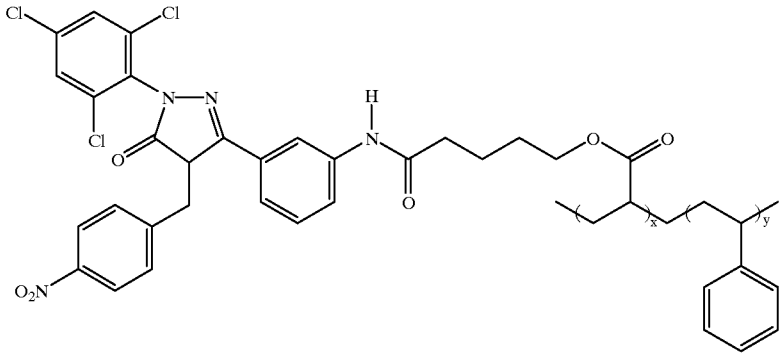 | 0.21 | 0.78 |

-continued
| COUPLER | FORMULA | Σσ(Q) | Σσ(P) |
|---|---|---|---|
| M-45 | 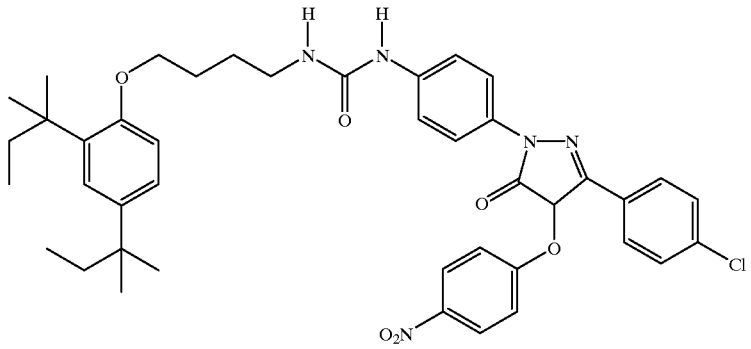 | 0.23 | 0.78 |
| M-46 | 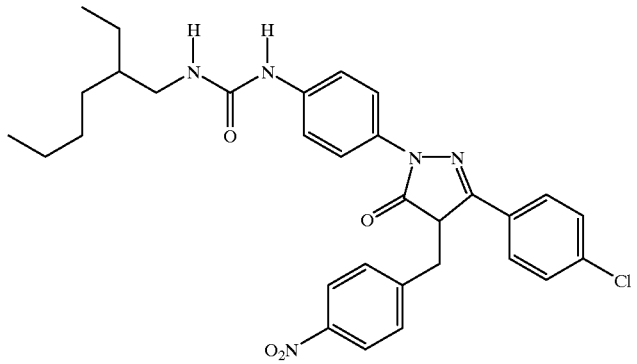 | 0.23 | 0.78 |
| M-47 | 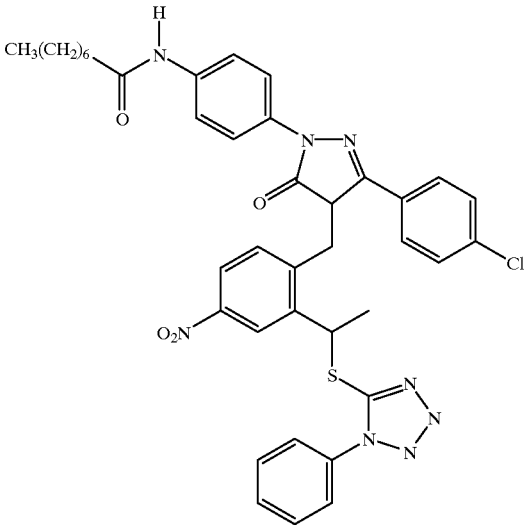 | 0.23 | 0.90 |

-continued

| COUPLER FORMULA | | Σσ(Q) | Σσ(P) |
|---|---|---|---|
| M-48 | 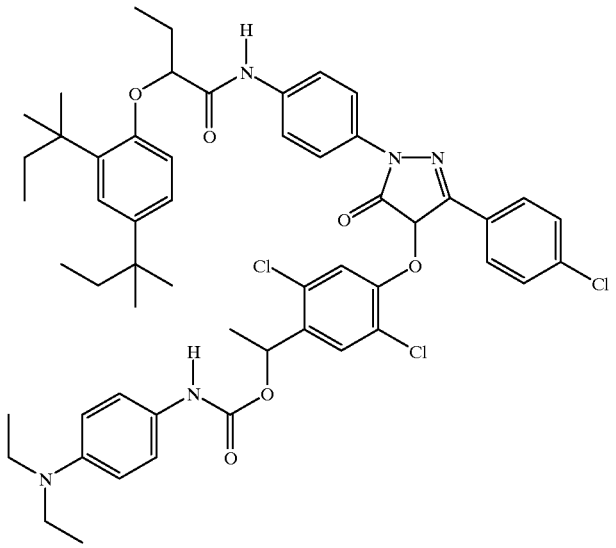 | 0.23 | [0.60] |

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-tolylcarbonyl amino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-( 2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di -t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethyihexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emswolth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure,* Item No. 36544 referenced above, is updated in the September 1996 *Research Disclosure,* Item No. 38957. Certain desirable photographic elements and processing steps, including those useful in conjunction with color reflective prints, are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442: 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp.126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. No. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240;EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0512304;EPO 0515 128;EPO 0534703;EPO 0554778;EPO 0558 145; EPO 0 571 959;EPO 0 583 832;EPO 0 583 834;EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp.112–126 (1961); as well as U.S. Pat. No. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Useful coated levels of the couplers of this invention range from about 0.010 to 2.15 g/m$^2$ or more typically from 0.03 to 1.50 g/m$^2$. Typically, couplers are incorporated in a silver halide emulsion layer in a mole ratio to silver of 0.05 to 1.0 and generally 0.1 to 0.5. The couplers of this invention are usually utilized by dissolving them in high-boiling coupler solvents and then dispersing the organic coupler plus coupler solvent mixtures as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl-alkyl phosphonates, phosphine oxides (e.g. trioctylphosphine oxide), esters of aromatic acids (e.g. dibutyl phthalate, octyl benzoate, or benzyl salicylate), esters of aliphatic acids (e.g. acetyl tributyl citrate, tripentyl citrate, or dibutyl sebacate), alcohols (e.g. 2-hexyl-1-decanol), phenols (e.g. p-docecylphenol), carbonamides(e.g. N,N-dibutyldodecanamide or N-butylacetanilide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional coupler solvents and auxiliary solvents are noted in Research Disclosure, December 1989, Item 308119, p. 993. Useful coupler: coupler solvent weight ratios range from about 1:0.1 to 1:8.0 with 1:0.2 to 1:4.0 being preferred. Dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

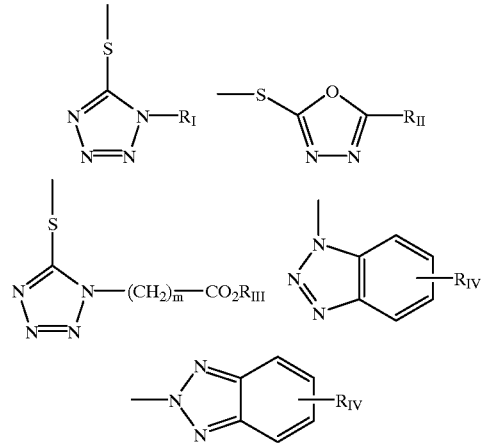

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat No. 4,248,962); groups utilizing an electron transfer reaction along a conjugated system (U.S. Pat. No. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

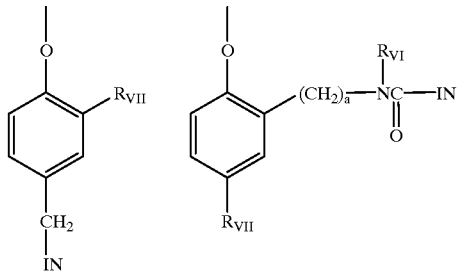

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

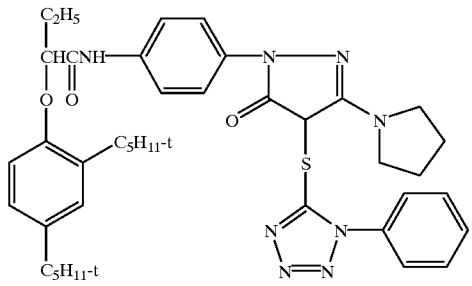

-continued

D2

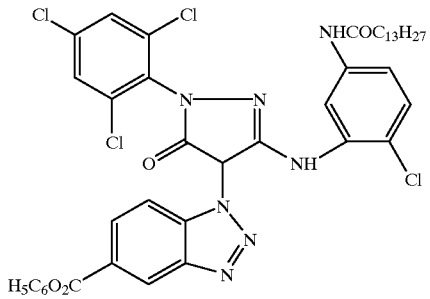

D3

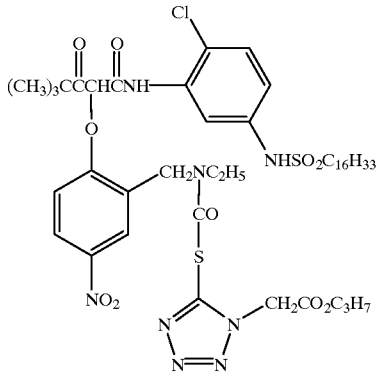

D4

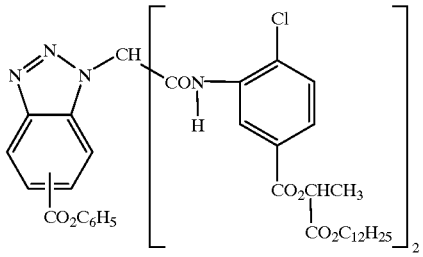

D5

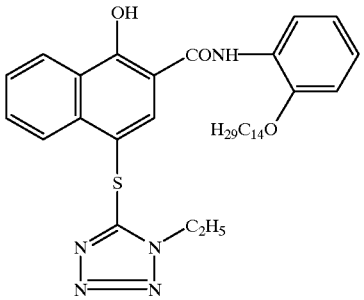

-continued
D6
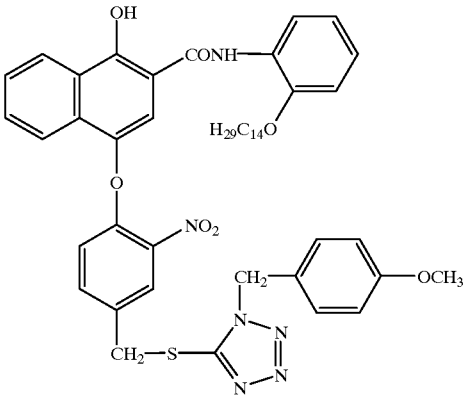
D7
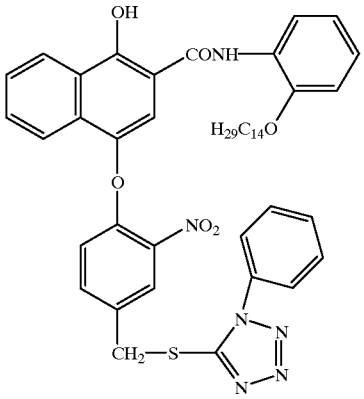
D8
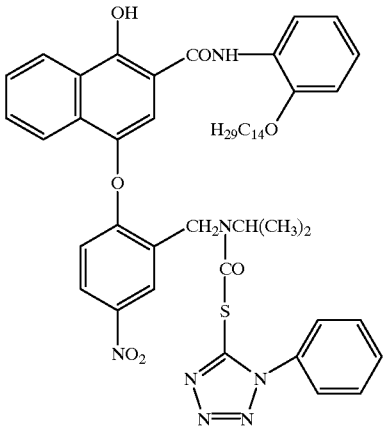
-continued
D9
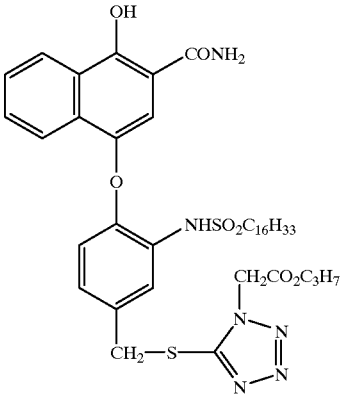
D10
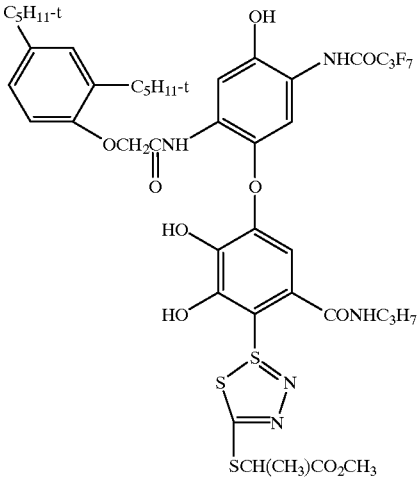
D11
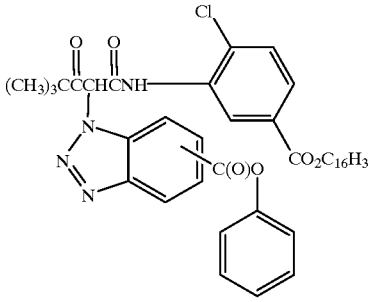
D12
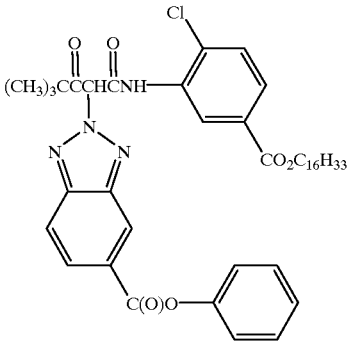

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072, 633; 90-072,634; 90-077,822; 90-078,229; 90-078,230; 90-079,336; 90-079,337; 90-079,338; 90-079,690; 90-079, 691; 90-080,487; 90-080,488; 90-080,489; 90-080,490; 90-080,491; 90-080,492; 90-080,494; 90-085,928; 90-086, 669; 90-086,670; 90-087,360; 90-087,361; 90-087,362; 90-087,363; 90-087,364; 90-088,097; 90-093,662; 90-093, 663; 90-093,664; 90-093,665; 90-093,666; 90-093,668; 90-094,055; 90-094,056; 90-103,409; 83-62,586; 83-09, 959.

Conventional radiation-sensitive silver halide emulsions can be employed in the practice of this invention. Such emulsions are illustrated by *Research Disclosure,* Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435, 501, 4,463,087 and 4,173,320, Daubendiek et al U.S. Pat. Nos. 4,414,310 and 4,914,014, Sowinski et al U.S. Pat. No. 4,656,122. Piggin et al U.S. Pat. Nos. 5,061,616 and 5,061, 609, Tsaur et al U.S. Pat. Nos. 5,147,771, '772, '773, 5,171,659 and 5,252,453, Black et al 5,219,720 and 5,334, 495, Delton U.S. Pat. Nos. 5,310,644, 5,372,927 and 5,460, 934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713, 323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271, 858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320, 938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. If desired "Redox Amplification" as described in Research Disclosure XVIIIB(5) may be used.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Another type of color negative element is a color print. Such an element is designed to receive an image optically printed from an image capture color negative element. A color print element may be provided on a reflective support for reflective viewing (e.g. a snap shot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)ani line sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications referred to in this specification are incorporated herein by reference.

Synthesis Examples

Compounds M-7 and M-12

Synthetic Scheme for M-7 and M-12

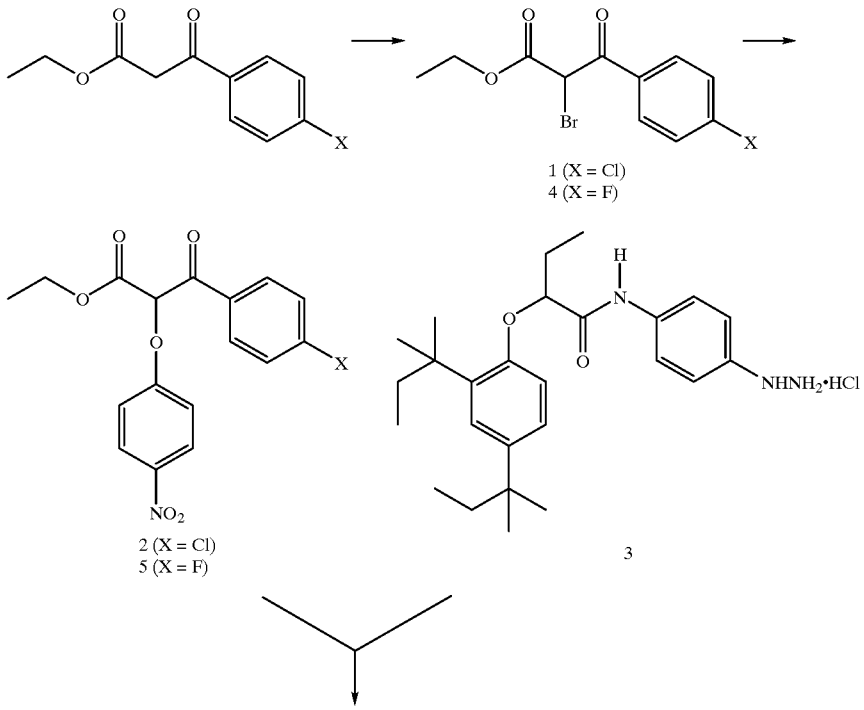

-continued

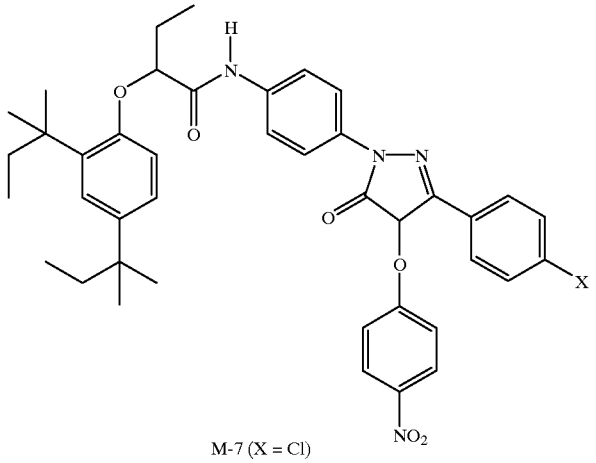

M-7 (X = Cl)
M-12 (X = F)

Preparation of Bromoketoester 1

A solution of bromine (17.60 g, 110 mmol) in 25 mL of carbon tetrachloride was added in drops at room temperature over a period of 40 min to a solution of ethyl 4-chlorobenzoylacetate (22.67 g, 100 mmol) in 50 mL of carbon tetrachloride. Following the addition, the solution was stirred at room temperature for 20 h, concentrated, and dissolved in 150 mL of ether. The solution was washed in succession with 5% aqueous sodium bisulfite (50 mL), saturated aqueous sodium bicarbonate (2×50 mL), water (2×50 mL), brine (50 ML), dried over magnesium sulfate and concentrated to an oil. The yield of 1 was 29.84 g (98 mmol, 98%).

Preparation of p-Nitrophenyloxyketoester 2

Potassium carbonate (5.54 g, 40 mmol) was added to a solution of 1 (11.00 g 36 mmol) and 4-nitrophenol (5.28 g, 38 mmol) in 40 mL of acetone. The mixture was stirred at room temperature for 1 h and the solvent was distilled off. The residue was partitioned between 300 mL of ether/100 mL of 5% aqueous hydrochloric acid and the ethereal solution was washed with 5% aqueous hydrochloric acid (2×100 mL), water (2×100 mL), and brine (100 mL); drying over magnesium sulfate and removal of the solvent produced an oil which crystallized when stirred with 30 mL of isopropyl ether. The yield of 2 was 4.02 g (11 mmol, 31%).

Preparation of M-7

A solution of 2 (3.64 g, 10 mmol) and the ballasted phenyl hydrazine hydrochloride 3 (4.62 g, 10 mmol) in methanol (35 mL) was stirred at room temperature for 4 days. The crude product was purified by column chromatography on silica gel. The yield of M-7 was 4.67 g (6.4 mmol, 64%); $M^+$724.

Preparation of 4

Prepared as described for 1 from ethyl 4-fluorobenzoylacetate (21.02 g, 100 mmol). The yield of 4 was 25.53 g (88 mmol, 88%).

Preparation of 5

Tetramethylguanidine (6.92 g, 60 mmol) was added rapidly to a solution of 4-nitrophenol (5.56 g, 40 mmol) and 4( 11.56 g, 40 mmol) in acetonitrile (60 mL), stirred at 5° C. under nitrogen. The mixture was stirred at room temperature for 18 h and the solvent distilled off. The residue was taken up in 1000 mL of ethyl acetate, washed with 5% aqueous hydrochloric acid (2×300 mL), water (300 mL), brine (300 mL), dried over magnesium sulfate and concentrated to an oil. The crude product was purified by crystallization from isopropyl ether giving 7.92 g (23 mmol, 58%) of 5.

Preparation of M-12

A solution of 5 (6.95 g, 20 mmol) and 3 (9.24 g, 20 mmol) in methanol (70 mL) was refluxed under nitrogen for 18 h, cooled , and the solvent was distilled off. The crude product was purified by column chromatography on silica gel giving 6.73 g (9.5 mmol, 48%) of M-12 as a glass; $M^+$708.

Preparation of Comparison Example C-7

Synthetic Scheme for C-7

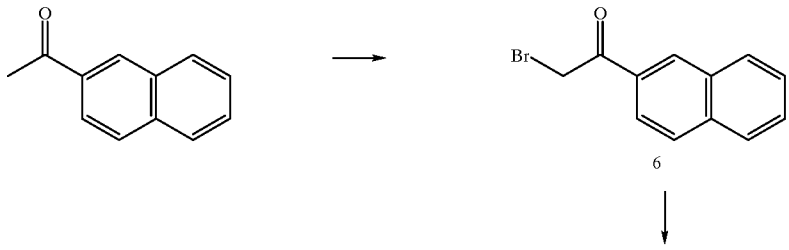

6

-continued

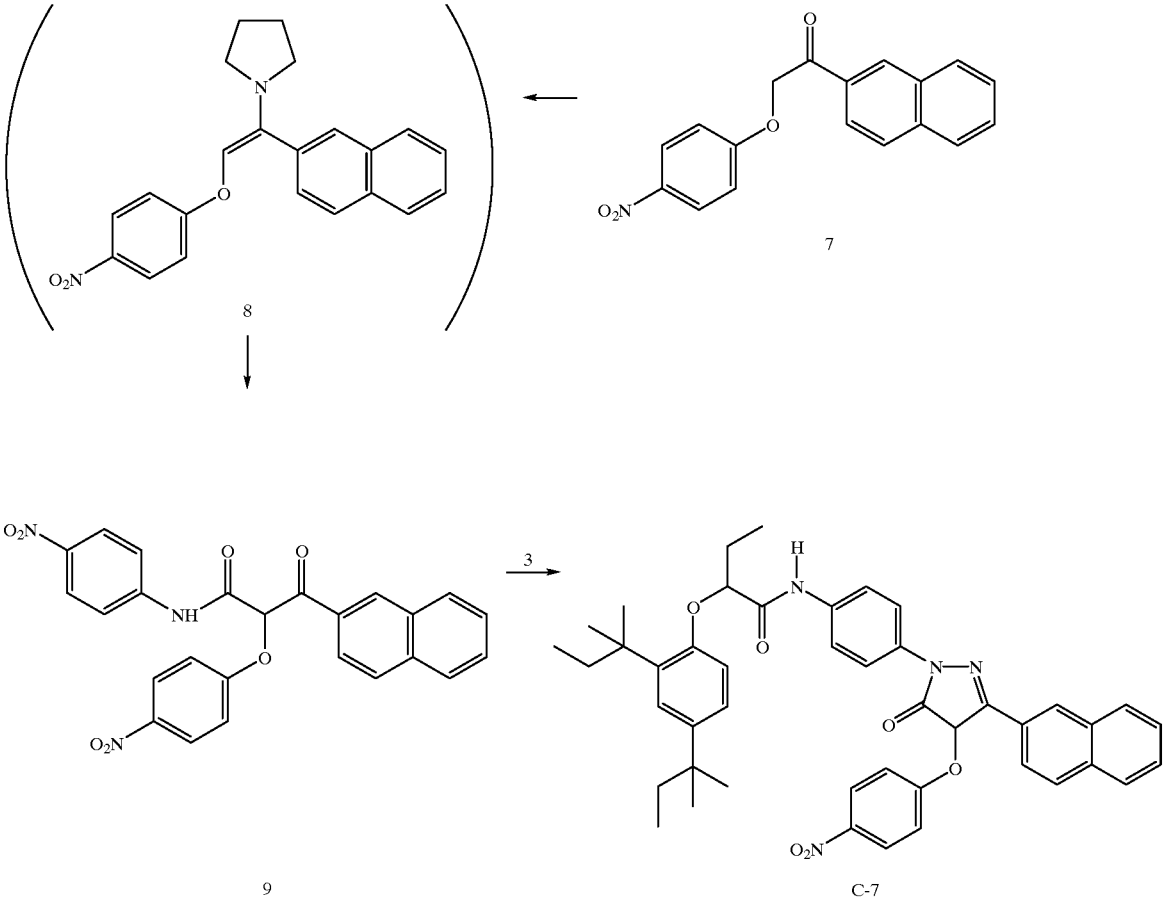

Preparation of Bromoacetonaphone 6

Solid phenyltrimethylammonium tribromide (37.60 g, 100 mmol) was added in portions at room temperature over a period of 40 min to a solution of 2-acetonaphthone (17.02 g, 100 mmol)in dichloromethane (250 mL). Following the addition, the solution was stirred at room temperature for 18 h. The solvent was then distilled off and the residue partitioned between water (200 mL) and ether (300 mL). The ethereal layer was washed with water (3×150 mL), dried over magnesium sulfate and taken to dryness. The remaining solid was washed with isopropyl ether (2×50 mL), petroleum ether (2×200 mL), and dried in vacuo. The yield of 6 was 18.27 g (73 mmol, 73%).

Preparation of p-Nitrophenoxyacetonaphthone 7

Solid potassium carbonate (8.71 g, 63 mmol) was added to a solution of 6 (14.95 g, 60 mmol) and p-nitrophenol (8.56 g, 61.5 mmol) in 90 mL of N,N-dimethylformamide. The resulting mixture was stirred at room temperature under nitrogen for 2.5 h, diluted with ether (200 mL), and poured into 1000 mL of water giving a solid. After stirring for 2 h the solid was filtered off, washed with water (7×200 mL), ethanol (3×50 mL), and dried in vacuo. The yield of 7 was 17.11 g (56 mmol, 93%).

Preparation of the Enamine 8 p-Toluenesulfonic acid monohydrate (50 mg) was added to a solution of 7 (3.07 g, 10 mmol) and pyrrolidine (2.5 mL; 36 mmol) in 25 mL of toluene. The mixture was refluxed under nitrogen using a Dean-Stark trap for 3 h, cooled to room temperature and washed with water (2×15 mL). The solvent was distilled off in vacuo leaving 8 as a dark-red oil.

Preparation of the β-Ketoanilide 9

Solid p-nitrophenylisocyanate (1.64 g, 10 mmol) was added to the solution of 8 (ca. 10 mmol) in 25 mL of toluene and the resulting solution was refluxed for 1 h. The solvent was distilled off, the residue taken up in methanol (30 mL), and the mixture refluxed with concentrated hydrochloric acid (1 mL) for 20 min giving a solid. After cooling to room temperature the mixture was filtered, the solid washed with methanol (2×10 mL) and dried in vacuo. The yield of 9 was 3.74 g (7.9 mmol, 79%).

Preparation of C-7

A mixture of the ballasted phenylhydrazine hydrochloride 3 (5.08 g, 11 mmol) and 9 (4.71 g, 10 mmol) in acetic acid/ethyl acetate (200 mL; 1/1) was refluxed for 1 h giving a solution. Ethyl acetate (500 mL) was added and the solution washed with 5% hydrochloric acid (200 mL0, water (6×200 mL), and brine (200 mL). Removal of the solvent left a foam which was purified by chromatography on silica gel. The yield of C-7 was 2.90 g (3.9 mmol, 39%).

Photographic Examples

The comparative couplers and inventive couplers used for the photographic examples were dispersed and coated with the high-boiling solvent tritolyl phosphate (S-1, mixed isomers). The dispersions were prepared by adding an oil phase containing a 1:1:3 weight ratio of coupler:tritolyl phosphate:ethyl acetate to an aqueous phase containing gelatin and the dispersing agent ALKANOL XC (Dupont) in a 10:1 weight ratio. Each of the resulting mixtures was passed through a colloid mill to disperse the coupler-containing oil phase in the aqueous phase as small particles. The resulting dispersions contained 2% by weight of coupler and 6% by weight of gelatin.

Sufficient coupler dispersion to yield a laydown of 0.646 mmol/sq.m was mixed with a silver iodobromide emulsion and additional gelatin and coated on cellulose acetate butyrate support. On coating, the ethyl acetate auxilliary solvent in the dispersion evaporates. The layer containing coupler and silver halide was overcoated with a layer containing gelatin and the hardener bis (vinylsulfonylmethyl)ether. The coating structure is shown in Table I with laydowns in g/sq m given in parenthesis (except where noted).

TABLE I

| |
|---|
| Overcoat: Gelatin (5.38) |
| Bis(vinylsulfonylmethyl)ether Hardener (0.161) |
| Gelatin (2.69) |
| Magenta dye-forming coupler (0.646 mmol/sq.m) & Tritolyl phosphate at equal weight to coupler |
| Ag as a 0.46 $\mu$m silver bromoiodide (6.4% iodide) emulsion (1.61) |
| cellulose acetate butyrate support |

After hardening, samples of each of the films were exposed through a step tablet on a 1B sensitometer and processed using the KODAK FLEXICOLOR C-41 color negative procedure A, or modified procedure B, described in Table II. The developer in procedure B contains 4.0 g/1 citrazinic acid (CZA) which competes with the in-film comparative and inventive couplers for oxidized developer. Measurements of status M green density vs. exposure were made for each processed film strip, and photographic contrast (gamma, $\gamma$) was determined from the slopes of such plots.

TABLE II

C-41 Processing Solutions and Conditions

| | Solution | Processing Time | Agitation Gas |
|---|---|---|---|
| A) | C-41 Developer | 3'15" | Nitrogen |
| or | | | |
| B) | C-41 Developer plus 4 0 g/1 Citrazinic Acid (CZA) | 3'15" | Nitrogen |
| | Stop Bath | 30" | Nitrogen |
| | Bleach | 3' | Air |
| | Wash | | None |
| | Fix | | Nitrogen |
| | Wash | | None |

TABLE II-continued

C-41 Processing Solutions and Conditions

| Solution | Processing Time | Agitation Gas |
|---|---|---|
| Bath containing wetting agent | 30" | None |
| Processing temperature 100° F. | | |

The activity of a coupler in film can be related to the resistance of its gamma in processing Procedure A ($\gamma_{C41}$) from being reduced in processing Procedure B ($\gamma_{CZA}$). One way to represent the activity is by the formula:

$$ACT=(\gamma_{CZA}/\gamma_{C41})\times 100.$$

The higher the number, the more active the coupler.

To evaluate the stability of the coupler, film samples were subjected to an accelerated raw stock keeping test. The test consisted of storage of unexposed, unprocessed samples at 100° F. and 50% relative humidity for 4 weeks. Samples were then exposed and processed in Procedure A. Values of Dmax, the maximum density obtained at high exposure, were compared to the earlier Procedure A processed, unkept films. Dmax values were corrected for Dmin to remove contributions to green density from the support and other coating components. The ratio of the corrected Dmax obtained from an incubated sample relative, to the corrected Dmax of a sample of the same film processed immediately following hardening, is referred to as the Density Ratio (DR):

$$DR=[(Dmax_{(incubated)}-Dmin)/(Dmax_{(fresh)}-Dmin)]\times 100$$

This ratio is a measure of the raw stock stability of the coupler in the film composition. The higher the number, the more stable the coupler. Many of the couplers were coated in different sets. To reduce variation when comparing sets, CK-1 was coated, processed, and incubated in a like manner to comparative and inventive couplers and used as an internal check in all keeping tests. Its value for Density Ratio over many experiments was averaged and used to normalize the Density Ratios for the comparative and inventive couplers:

$$DR(normalized)=[DR(CK\text{-}1\ average)/DR(CK\text{-}1\ for\ set)]\times DR(test)$$

CK-1

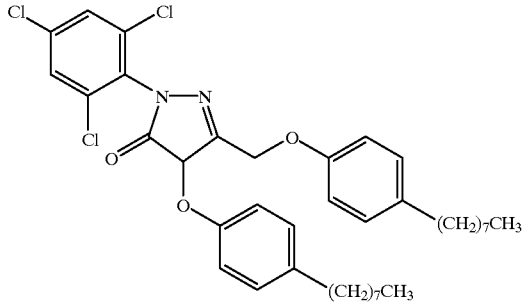

In the following examples, the indicated comparison examples were employed:

| COUPLER | FORMULA | Σσ(Q) | Σσ(P) |
|---|---|---|---|
| C-1 | 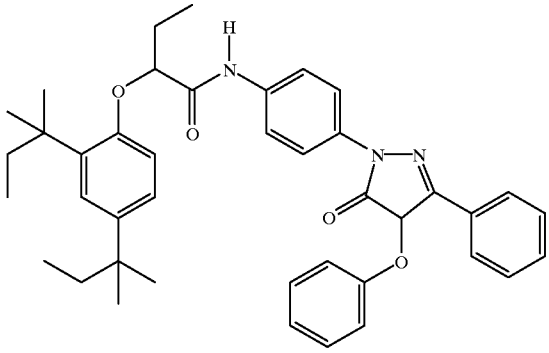 | 0.00 | 0.00 |
| C-2 | 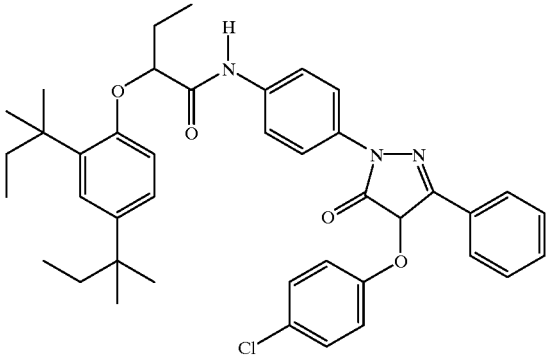 | 0.00 | 0.23 |
| C-3 | 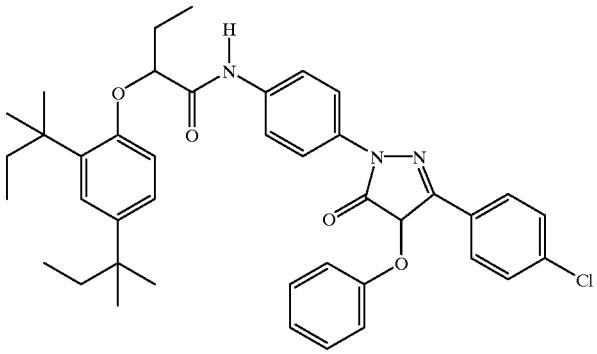 | 0.23 | 0.00 |
| C-4 | 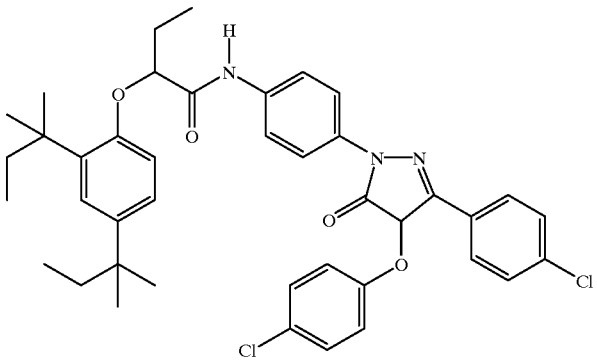 | 0.23 | 0.23 |

-continued
| COUPLER | FORMULA | Σσ(Q) | Σσ(P) |
|---|---|---|---|
| C-5 | 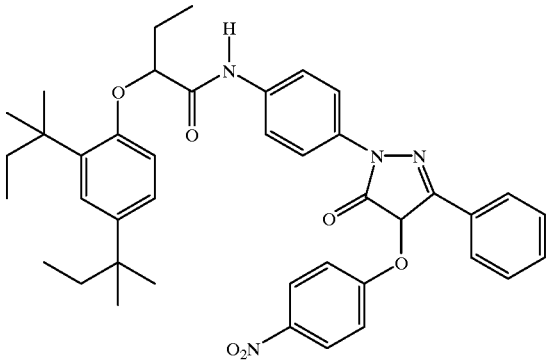 | 0.00 | 0.78 |
| C-6 | 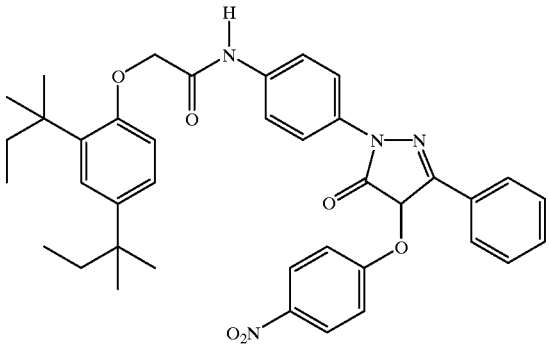 | 0.00 | 0.78 |
| C-7 | 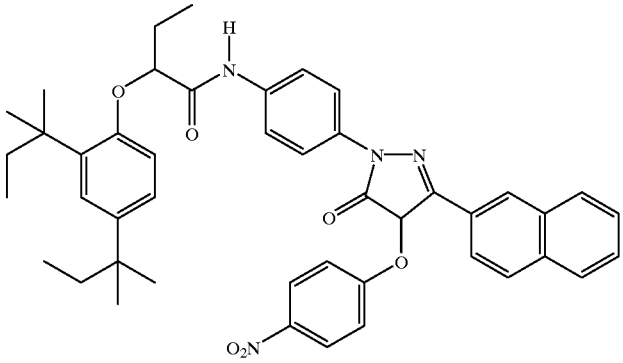 | 0.04 | 0.78 |
| C-8 | 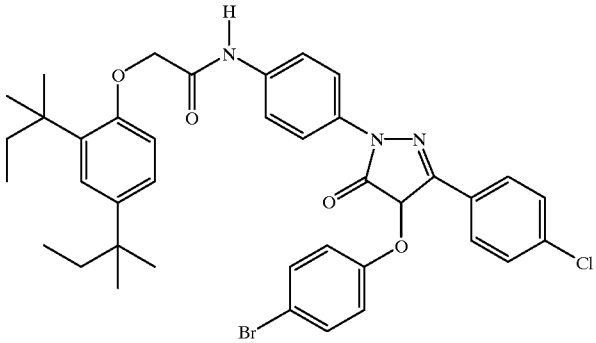 | 0.23 | 0.23 |

-continued

| COUPLER | FORMULA | Σσ(Q) | Σσ(P) |
|---|---|---|---|
| C-9 | 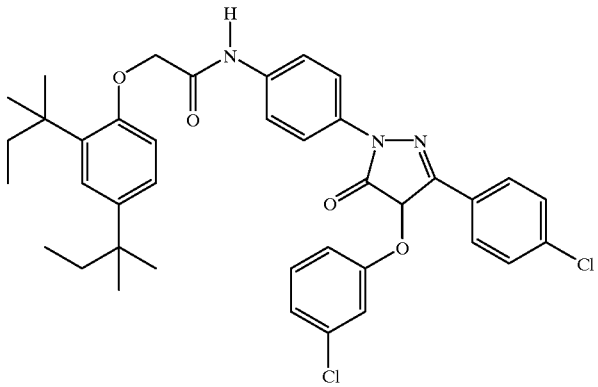 | 0.23 | 0.37 |
| C-10 | 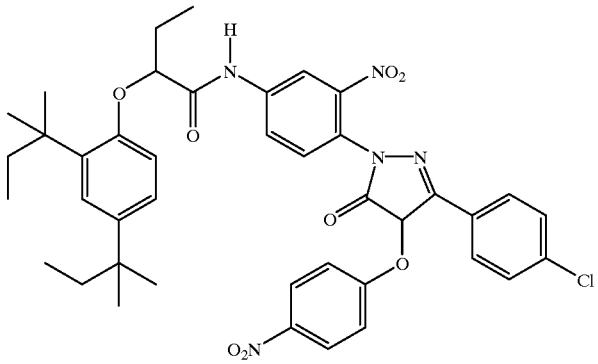 | 0.23 | 0.78 |

EXAMPLE 1

Couplers of this invention M-5, M-7, M-13, M-27, and M-28, and comparison couplers C-5, C-6, and C-7 were dispersed and coated as described and processed in Procedure A and B. In addition, film samples were subjected to an accelerated raw stock keeping test under the conditions indicated, exposed and processed, and normalized Density Ratios were determined as described. The inventive couplers were all based on the same coupling-off group while the substituents in the parent pyrazolone at the 1-position (nitrogen) and the 3-position (carbon) were varied. Table III shows the results of the tests.

TABLE III

Density Ratio + Activity Improvements

| Coupler | Type | Σσ(Q) | Σσ(P) | Density Ratio(DR)[1] | ACT | DR + ACT |
|---|---|---|---|---|---|---|
| C-5 | Comp | 0.00 | 0.78 | 85.6 | 80.7 | 166.3 |
| C-6 | Comp | 0.00 | 0.78 | 83.7 | 91.0 | 174.7 |
| C-7 | Comp | 0.04 | 0.78 | 80.5 | 89.8 | 170.3 |
| M-5 | Inv | 0.37 | 0.78 | 86.0 | 88.5 | 174.5 |
| M-7 | Inv | 0.23 | 0.78 | 89.3 | 82.3 | 171.6 |
| M-13 | Inv | 0.54 | 0.78 | 100.0 | 80.8 | 180.8 |
| M-27 | Inv | 0.10 | 0.78 | 100.0 | 88.4 | 188.4 |
| M-28 | Inv | 0.10 | 0.78 | 100.0 | 84.1 | 184.1 |

[1]Keeping results are based on 4 weeks @100° F. and are normalized.

Both raw stock stability and coupler activity are important properties of couplers in films. Preferred raw stock keeping is 95 or better, with a value of 85 being acceptable. Preferred coupler activity is 75 or higher, with 70 being acceptable. However, in the absence of at least acceptable raw stock stability, activity is of no value. Therefore, we have found that while both keeping and activity must satisfy at least the acceptable criteria, an important metric is that the sum of activity (ACT) and keeping (DR) be greater than 170 with the density ratio for raw stock stability being at least 85.

It is evident from the sum of normalized Density Ratio values and Activities in Table III that the photographic elements of the invention which contain the specified magenta dye forming couplers show satisfactory values in the sum test, all being greater than 170. In addition the Density Ratio values all show satisfactory stability in the raw stock keeping test, with all values being in the preferred range. Excellent results are obtained for couplers where the substituent bonded to the nitrogen at the 1-position is unsubstituted phenyl (M-27), substituted phenyl (M-5, 7, 13, 28), ballasted phenyl(M-5, 7, 13), or unballasted phenyl (M-27, 28). Variation in the 3-position as permitted by the invention also produced excellent results.

The comparison couplers failed to produce acceptable results. Couplers C-5, C-6 and C-7 are all deficient in the substituent bonded to the phenyl in the 3-position of the pyrazolone. Each comparison has a Hammett σ constant sum of less than 0.05. C-5 fails by the sum of Density Ratio and Activity being less than 170, and C-6 and C-7 satisfy the sum criteria but have unacceptable Density Ratio values.

EXAMPLE 2

Photographic element samples were prepared and tested in a manner similar to Example 1 except this time the type of parent pyrazolone group was held constant while the coupling-off group was varied in order to determine the effect on the keeping results. Table IV shows the results of testing.

TABLE IV

| Density Ratio + Activity Improvements | | | | | | |
|---|---|---|---|---|---|---|
| Coupler | Type | Σσ(Q) | Σσ(P) | Density Ratio(DR)[1] | ACT | DR + ACT |
| C-1 | Comp | 0.00 | 0.00 | 41.2 | 88.8 | 130.0 |
| C-2 | Comp | 0.00 | 0.23 | 62.0 | 90.8 | 152.8 |
| C-3 | Comp | 0.23 | 0.00 | 55.6 | 89.5 | 145.1 |
| C-4 | Comp | 0.23 | 0.23 | 77.8 | 92.8 | 170.6 |
| C-8 | Comp | 0.23 | 0.23 | 76.1 | 91.2 | 167.3 |
| C-9 | Comp | 0.23 | 0.37 | 81.7 | 95.8 | 177.5 |
| M-7 | Inv | 0.23 | 0.78 | 89.3 | 82.3 | 171.6 |
| M-20 | Inv | 0.23 | 0.66 | 87.4 | 86.2 | 173.6 |
| M-21 | Inv | 0.23 | 0.54 | 96.8 | 86.8 | 183.6 |

[1]Keeping results are based on 4 weeks @100° F. and are normalized.

As shown by Table IV satisfactory results as indicated by the criteria that the sum of Density Ratio+Activity is at least equal to 170, and Density Ratio at least equal to 85 are not obtained when the substituents on the aromatic group of the coupling-off group are not within the invention. The sum of the Hammett constant (σ) values for these substituents of the coupling-off group are either less than 0.4 or the sum of the Hammett constant (σ) values are less than 0.05 on the 3-phenyl group of the pyrazolone ring. On the other hand, the three Examples of the invention provide Density Ratio+Activity sums of greater than 170 and Density Ratios of 85 higher.

One group (C-3, C-4, and M-7) has the same 1-phenyl position ballast group and 3-phenyl pyrazolone substituent with varying coupling off groups. Only with a Hammett constant within the invention are the sum criteria of DR+Act achieved, and DR is greater than 85.

C-8, C-9, M-20, and M-21 have the same 1-phenyl and 3-phenyl substituents, but differ in the coupling off group. Only when the criteria of the invention are met, are the sum criteria of DR+Act, and DR at 85 met. The group C-1, C-2, C-5 have the same 1-phenyl and 3-phenyl substituents but differ in coupling off group. Even though one case, C-5, meets the invention requirement for Hammett constant for coupling off group substituent, none of these materials are satisfactory since the Hammett constant requirements for the 3-phenyl group are not met.

EXAMPLE 3

Photographic element samples were prepared and tested in a manner similar to Example 1 except the pyrazolone substituents at the nitrogen-1 position were varied as to ortho groups on the nitrogen-1 phenyl group. The substituents on carbon-3 and carbon-4 were not varied. Table V shows the results of testing.

TABLE V

| Density Ratio + Activity Improvements | | | | | | |
|---|---|---|---|---|---|---|
| Coupler | Type | Σσ(Q) | Σσ(P) | Density Ratio(DR)[1] | ACT | DR + ACT |
| C-5 | Comp | 0.00 | 0.78 | 85.6 | 80.7 | 166.3 |
| C-10 | Comp | 0.23 | 0.78 | 55.0 | 83.1 | 138.1 |
| M-7 | Inv | 0.23 | 0.78 | 89.3 | 82.3 | 171.6 |

TABLE V-continued

| Density Ratio + Activity Improvements | | | | | | |
|---|---|---|---|---|---|---|
| Coupler | Type | Σσ(Q) | Σσ(P) | Density Ratio(DR)[1] | ACT | DR + ACT |
| M-16 | Inv | 0.23 | 0.78 | 100.0 | 82.4 | 182.4 |
| M-17 | Inv | 0.23 | 0.78 | 94.9 | 77.3 | 172.2 |
| M-18 | Inv | 0.23 | 0.78 | 95.7 | 77.4 | 173.1 |

[1]Keeping results are based on 4 weeks @100° F. and are normalized.

Table V shows that satisfactory results are obtained for our inventive materials—as indicated by the Sum criteria (DR+ACT is at least equal to 170), and DR is at least 85—when the Hammett constant requirements are met (M-7, M-16,M-17, and M-18 versus C-5). The data also show that even if the Hammett requirements of the invention are met, a nitro group in the ortho position of a nitrogen-1 phenyl substituent results in an unstable compound (C-10) that fails the Sum and DR criteria, even when other ortho substituents still satisfy that criteria (M-7, M-16, M-17, and M-18).

EXAMPLE 4

Multilayer Film Structure Comprising a 4-Aryloxypyrazolone Coupler of This Invention The multilayer film structure utilized for this example is shown schematically in Table VI. Structures of components not provided previously are given immediately following Table VI. Component laydowns are provided in units of g/sq m unless otherwise indicated. This composition may also be coated on a support, such as polyethylene naphthalate, containing a magnetic recording layer. The use of the 4-aryloxy-1-aryl-3-arylpyrazolo-5-one imaging coupler M-13 of this invention provides reduced coupler laydowns useful for layer thinning and improved sharpness. The color negative film described in Table VI may be processed using KODAK FLEXICOLOR C-41 chemistry to yield excellent latitude and sharpness.

TABLE VI

| MULTILAYER FILM STRUCTURE | |
|---|---|
| 1 Overcoat & UV Layer: | Matte Bead<br>Uv Absorbers UV-1 (0.108), UV-2 (0.108) & S-1 (0.151)<br>Silver Bromide Lippmann Emulsion (0.215 Ag)<br>Gelatin (1.237)<br>Bis(vinylsulfonyl)methane Hardener (1.75 % of Total Gelatin) |
| 2 Fast Yellow Layer: | Y-1 (0.237) Yellow Dye-Forming Coupler & S-1 (0.118)<br>IR-1 (0.076) DIR Coupler & S-1 (0.038)<br>B-1 (0.0054) BARC & S-3 (0.0070)<br>Blue Sensitive Silver Iodobromide Emulsion (0.377 Ag), 4.1 mole % Iodide T-Grain (2.9 × 0.12 μm)<br>Blue Sensitive Silver Iodobromide Emulsion (0.108 Ag) 4.1 mole % Iodide T-Grain (1.9 × 0.14 μm)<br>Gelatin (0.807) |
| 3 Slow Yellow Layer: | Y-1 (1.076) & S-1 (0.538)<br>IR-1 (0.076) & S-1 (0.038)<br>B-1 (0.022) & S-3 (0.028)<br>CC-1 (0.032) & S-2 (0.064)<br>IR-4 (0.032) & S-2 (0.064)<br>Blue Sensitive Silver Iodobromide Emulsion (0.398 Ag), 4.1 mole % Iodide T-Grain (1.9 × 0.14 μm)<br>Blue Sensitive Silver Iodobromide Emulsion (0.269 Ag), 1.3 mole % Iodide T-Grain (0.54 × 0.08 μm)<br>Blue Sensitive Silver Iodobromide Emulsion (0.247 Ag) 1.5 mole % Iodide T-Grain (0.77 × 0.14 μm) |

TABLE VI-continued

| MULTILAYER FILM STRUCTURE | |
|---|---|
| | Gelatin (1.872) |
| 4 Yellow Filter Layer: | R-1 (0.086) & S-2 (0.139) & ST-2 (0.012)<br>YD-2 Filter Dye (0.054)<br>Gelatin (0.646) |
| 5 Fast Magenta Layer | M-13(0.064) Inventive Magenta Dye-Forming Coupler & S-1 (0.064)<br>R-2 (0.009)<br>MM-1 (0.054) Masking Coupler & S-1 (0.108)<br>IR-3 (.030) DIR Coupler & S-2 (0.060)<br>B-1 (0.003) & S-3 (0.004)<br>Green Sensitive Silver Iodobromide Emulsion (0.484 Ag), 4.0 mole % Iodide T-Grain (1.60 × 0.12 μm)<br>Gelatin (1.014) |
| 6 Mid Magenta Layer: | M-13 (0.105) & S-1 (0.105)<br>MM-1 (0.118) & S-1 (0.236), R-2 (0.015)<br>IR-2 (0.043) DIR Coupler & S-2 (0.043)<br>Green Sensitive Silver Iodobromide Emulsion (0.247 Ag), 4.0 mole % Iodide T-Grain (1.20 × 0.11 μm)<br>Green Sensitive Silver Iodobromide Emulsion (0.247 Ag) 4.0 mole % Iodide T-Grain (1.00 × 0.12 μm)<br>Gelatin (1.216) |
| 7 Slow Magenta Layer: | M-13 (0.228) & S-1 (0.228)<br>MM-1 (0.086) & S-1 (0.172)<br>IR-2 (0.011) & S-2 (0.011)<br>Green Sensitive Silver Iodobromide Emulsion (0.344 Ag), 3.5 mole % Iodide T-Grain (0.90 × 0.12 μm)<br>Green Sensitive Silver Iodobromide Emulsion (0.129 Ag), 1.5 mole % Iodide T-Grain (0.50 × 0.08 μm)<br>Gelatin (1.076) |
| 8 Interlayer: | R-1 (0.086) Interlayer Scavenger, S-2 (0.139) & ST-2 (0.012)<br>Gelatin (0.538) |
| 9 Fast Cyan Layer: | CC-1 (0.183) Cyan Dye-Forming Coupler & S-2 (0.210)<br>CM-1 (0.022) Masking Coupler<br>W-4 (0.027) DIAR Coupler & S-2 (0.054)<br>Red Sensitive Silver Iodobromide Emulsion (0.592 Ag), 4.1 mole % Iodide T-Grain (1.7 × 0.12 μm)<br>Gelatin (0.915) |
| 10 Mid Cyan Layer: | CC-1 (0.170) & S-2 (0.190)<br>CM-1 (0.032)<br>B-1 (0.008) & S-3 (0.010)<br>IR-4 (0.019) & S-2 (0.038)<br>Red Sensitive Silver Iodobromide Emulsion (0.194 Ag), 4.1 mole % Iodide T-Grain (1.2 × 0.11 μm)<br>Red Sensitive Silver Iodobromide Emulsion (0.236 Ag), 4.1 mole % Iodide T-Grain (0.91 × 0.11 μm)<br>Gelatin (1.076) |
| 11 Slow Cyan Layer: | CC-1 (0.533) & S-2 (0.560)<br>IR-4 (0.026) & S-2 (0.052)<br>CM-1 (0.032)<br>B-1 (0.056) & S-3 (0.073)<br>Red Sensitive Silver Iodobromide Emulsion (0.463 Ag), 1.5 mole % Iodide T-Grain (0.54 × 0.06 μm)<br>Red Sensitive Silver Iodobromide Emulsion (0.301 Ag) 4.1 mole % Iodide T-Grain (0.53 × 0.12 μm)<br>Gelatin (1.679) |
| 12 Antihalation Layer: | Gray Silver (0.135)<br>UV-1 (0.075), UV-2 (0.030), S-1 (0.042) S-4 (0.015)<br>YD-1 (0.034), MD-1 (0.018) & S-5 (0.018)<br>CD-1 (0.025) & S-2 (0.125)<br>R-1 (0.161), S-2 (0.261) & ST-2 (0.022)<br>Gelatin (2.04) |
| Cellulose Triacetate Support | |

B-1

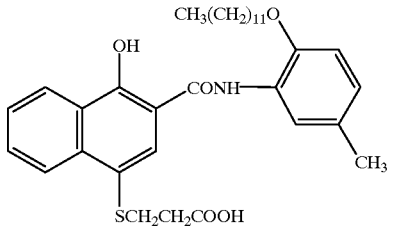

CC-1

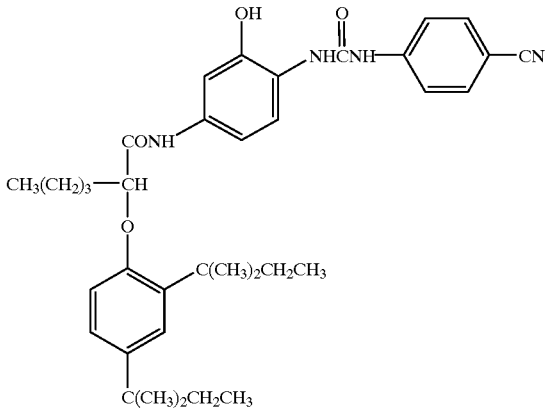

-continued
CD-1
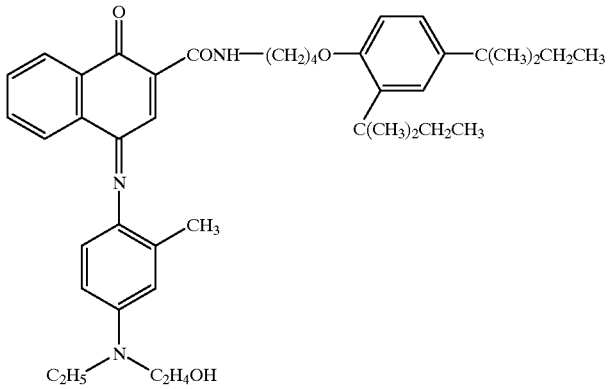
CM-1
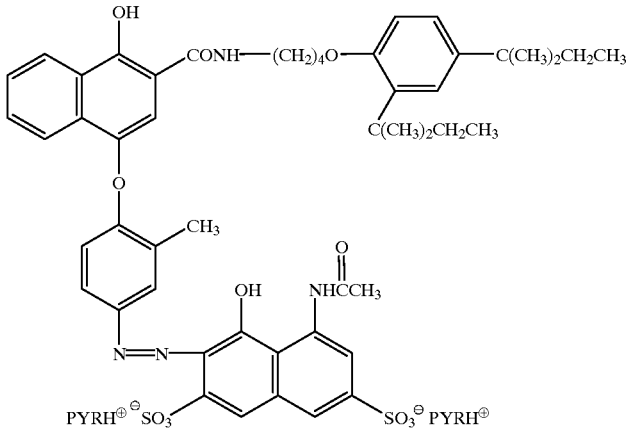
IR-1
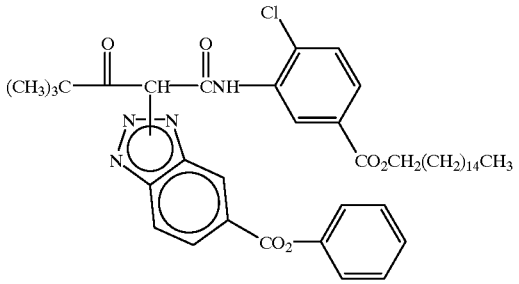
IR-2
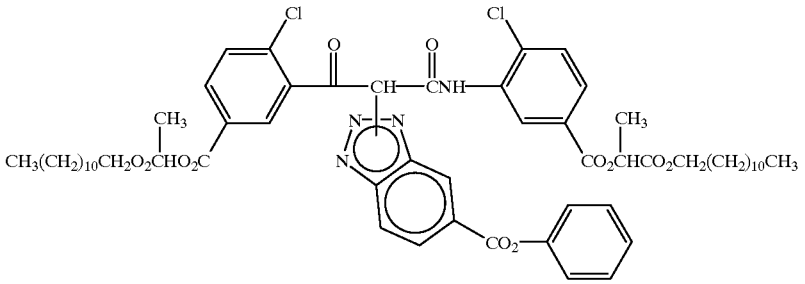

-continued
IR-3
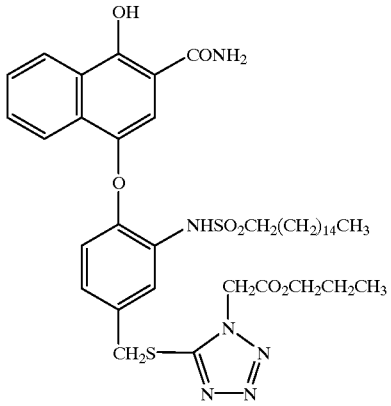
IR-4
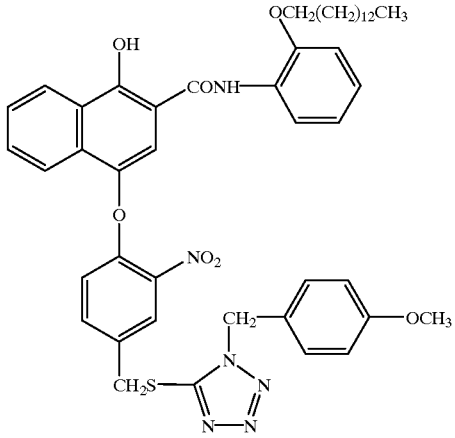
MC-1
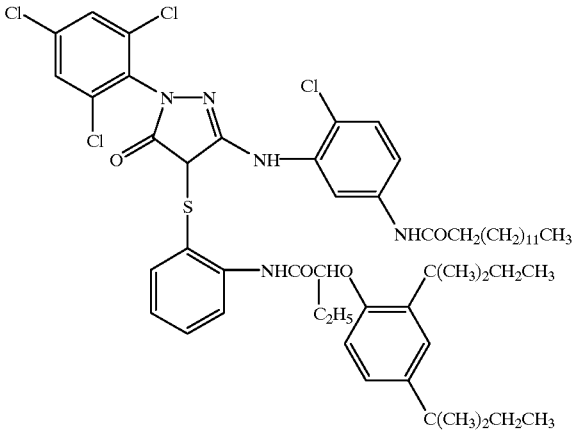
MD-1
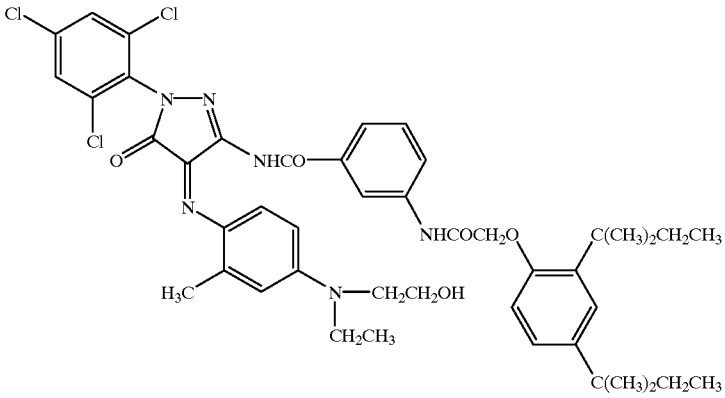

-continued
MM-1
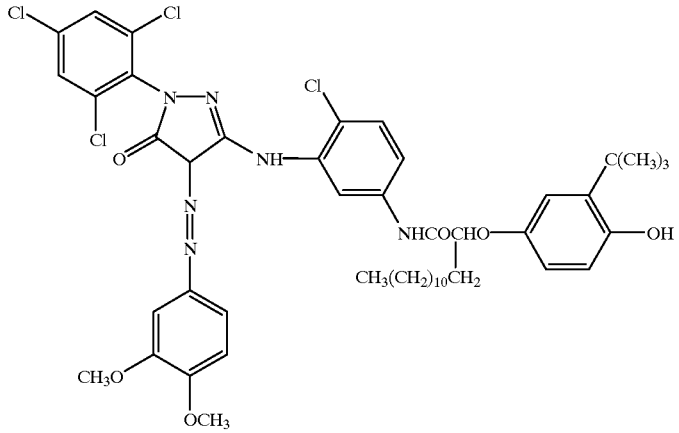
R-1
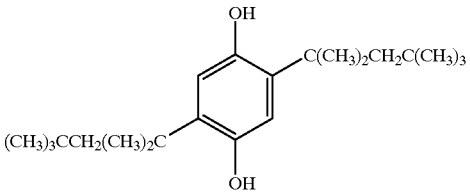
R-2
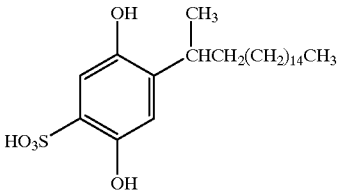
S-1
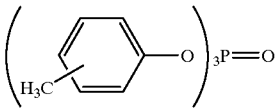
Mixed isomers
S-2
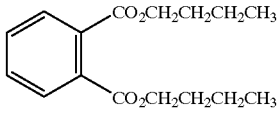
S-3
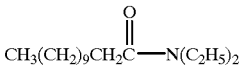
S-4
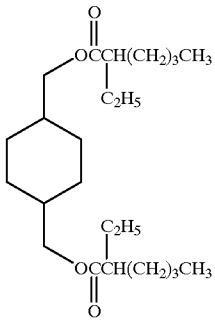
S-5
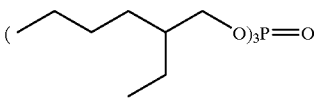
ST-1
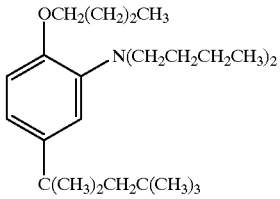
ST-2
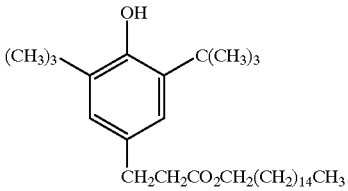
UV-1
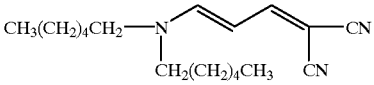

-continued

UV-2

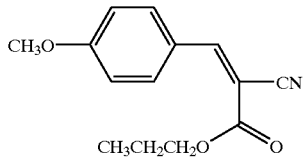

Y-1

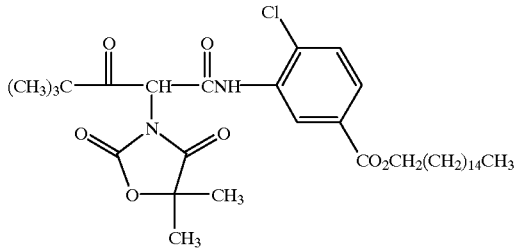

YD-1

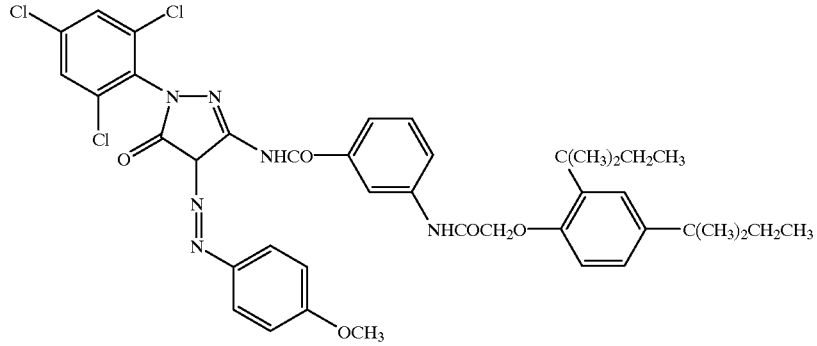

YD-2

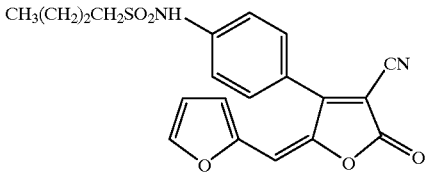

The entire contents of the patent applications, patents and other publications referred to in this specification are incorporated herein by reference.

The preceding examples are set forth to illustrate specific embodiments of this invention and are not intended to limit the scope of the compositions, materials or methods of the invention. Additional embodiments and advantages within the scope of the claimed invention will be apparent to one skilled in the art.

What is claimed is:

1. A photographic element comprising a light-sensitive silver halide emulsion layer having associated therewith a coupler based on a 1-aryl-3-arylpyrazol-5-one ring and represented by formula I:

I

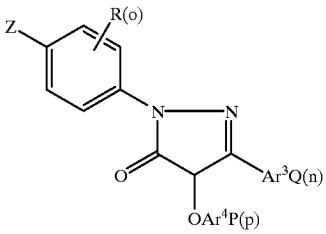

wherein:

Z represents hydrogen, alkyl, aryl, halogen or a group further defined as:

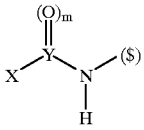

wherein:

X represents an aryl, alkyl, alkylamino, or an arylamino group;

Y represents carbon or sulfur; m is 1 when Y is carbon and 2 when Y is sulfur;

($) denotes the bond connecting the nitrogen atom and the phenyl ring;

R represents a halogen, an alkyl group, an alkoxy group, a cyano group, and a nitro group; and o is 0 to 4; and provided further that R may not be a nitro group ortho to the bond linking the phenyl ring to the 1 position of the pyrazolone ring; and $Ar^3$ represents an aryl group;

Q represents n independently selected substituents bonded to the $Ar^3$ ring, provided that the sum of the appropriate Hammett's σ constants for all Q substituents is at least 0.05; and n is 1 to 5, provided that two or more Q substituents may join to form one or more additional rings;

$OAr^4$ is an aryloxy group;

P represents p independently selected substituents bonded to the aryloxy ring, provided that the sum of the appropriate Hammett's σ constants for all P substituents is at least 0.4, and provided further that P may not be a nitro group ortho to the oxygen atom linking the aryloxy group to the 4 position of the pyrazolone ring, provided that two or more P substituents may join to form one or more additional rings, and p is 1 to 5.

2. The element of claim 1 wherein $Ar^3$ is a phenyl group.

3. The element of claim 2 wherein $Ar^3$ is a phenyl group containing a substituent Q selected from the group consisting of halogen, —$NO_2$, —CN, —OR', —NR'$SO_2$R", —NR'C(O)R", —C(O)N(R')R", —C(O)OR', —OC(O)R', —C(O)R', —$OSO_2$R',—$SO_2$R', —$SO_2$N(R')R", and —$SO_2$OR' groups wherein each R' and R" are independently hydrogen or a substituent group.

4. The element of claim 3 wherein $Ar^3$ is a phenyl group containing a substituent Q selected from the group consisting of halogen, —$NO_2$, —CN, —OR', —C(O)N(R')R", and —$SO_2$N(R')R" wherein each R' and R" is independently hydrogen or a substituent group.

5. The element of claim 2 wherein $Ar^3$ is a phenyl group containing a substituent Q that is halogen.

6. The element of claim 2 wherein $Ar^3$ is a p-chlorophenyl group.

7. The element of claim 2 wherein $Ar^3$ is a p-fluorophenyl group.

8. The element of claim 1 wherein $OAr^4$ is a phenoxy group.

9. The element of claim 8 wherein at least one P is selected from the group consisting of halogen, —$NO_2$, —N═NR', —CN, —NR'$SO_2$R", —NR'C(O)R", —C(O)N(R')R", —C(O)OR', —OC(O)R', —C(O)R', —$OSO_2$R',—$SO_2$R', —$SO_2$N(R')R", and —$SO_2$OR' wherein each R' and R" is independently hydrogen or a substituent group.

10. The element of claim 8 wherein at least one P is selected from the group consisting of —$NO_2$, —CN, —$SO_2$R', and —$SO_2$N(R')R", wherein each R' and R" is independently hydrogen or a substituent group.

11. The element of claim 8 wherein at least one P is a nitro group.

12. The element of claim 1 wherein Z contains a group Y that is carbon.

13. The element of claim 1 wherein Z contains a group Y that is sulfur.

14. The element of claim 1 where X is a 2,4-di(t-pentyl) phenoxymethyl group.

15. The element of claim 1 where X is a 1-[2,4-di(t-pentyl)phenoxy]-1-propyl group.

16. The element of claim 1 wherein —$OAr^4P_{(p)}$ contains a photographically useful group (PUG) or a precursor thereof.

17. The element of claim 16 wherein the PUG group is a dye or dye precursor.

18. The element of claim 17 wherein the PUG dye group is ballasted so as not to washout during processing.

19. The element of claim 17 wherein the dye is not ballasted and washes out during processing.

20. The element of claim 16 wherein the PUG is a development inhibitor or precursor thereof.

21. The element of claim 16 wherein the PUG is a bleach inhibitor or precursor thereof.

22. The element of claim 16 wherein the PUG is a developer or a precursor thereof.

* * * * *